US005699693A

United States Patent [19]

Nogami et al.

[11] Patent Number: 5,699,693

[45] Date of Patent: Dec. 23, 1997

[54] WIDTHWISE COMPRESSING MACHINE AND METHOD USING VIBRATIONS TO REDUCE MATERIAL WIDTH

[75] Inventors: Tadahiko Nogami, Mito; Ichiro Nakamura, Hitachinaka; Kenji Hiraku; Hiroyuki Sadamori, both of Ibaraki-ken; Kenichi Yasuda, Hitachinaka; Kenjiro Narita, Hitachi; Kenji Horii, Hitachi; Hironori Shimogama, Hitachi, all of Japan

[73] Assignee: Hitachi, Ltd., Tokyo, Japan

[21] Appl. No.: 527,182

[22] Filed: Sep. 12, 1995

[30] Foreign Application Priority Data

Sep. 14, 1994 [JP] Japan ..... 6-219820

[51] Int. Cl.[6] ..... B21B 11/00; B21B 15/00; B21J 5/00

[52] U.S. Cl. ..... 72/199; 72/206; 72/407; 72/416; 72/710

[58] Field of Search ..... 72/407, 184, 199, 72/206, 416, 710

[56] References Cited

U.S. PATENT DOCUMENTS

| | | | |
|---|---|---|---|
| 2,767,767 | 10/1956 | Peterson | 72/710 |
| 3,333,452 | 8/1967 | Sendzimir | 72/184 |
| 3,534,574 | 10/1970 | McMaster | 72/57 |
| 4,578,983 | 4/1986 | Kimura | 72/407 |
| 4,651,550 | 3/1987 | Nihei et al. | 72/710 |
| 5,046,344 | 9/1991 | Ginzburg et al. | 72/20 |

FOREIGN PATENT DOCUMENTS

| | | | |
|---|---|---|---|
| 363894 | 9/1981 | Austria . | |
| 112516 | 7/1984 | European Pat. Off. . | |
| 1147909 | 5/1963 | Germany | 72/710 |
| 222651 | 10/1986 | Japan | 72/184 |
| 570421 | 8/1977 | U.S.S.R. | 72/410 |
| 615957 | 7/1978 | U.S.S.R. | 72/710 |
| 617089 | 7/1978 | U.S.S.R. | 72/710 |
| 686794 | 9/1979 | U.S.S.R. | 72/410 |
| 789166 | 12/1980 | U.S.S.R. | 72/410 |

OTHER PUBLICATIONS

Patent Abstracts of Japan vol. 9 No. 275 (M-426) Nov. 2, 1985 & JP-A-60-121001 (Hitachi) 28 Jun. 1985 abstract; figures.

Patent Abstracts of Japan, vol. 11, No. 123 (M-581) Apr. 17, 1987 & JP-A-61 262401 (Hitachi) 20 Nov. 1986, abstract, figures.

Patent Abstracts of Japan, vol. 14, No. 393 (M-1050) 24 Aug. 1990 & JP-A-02 147109 (Hitachi) 6 Jun. 1990, abstract.

Patent Abstracts of Japan, vol. 18, No. 650(M-1719), 9 Dec. 1994 & JP-A-06 254606 (Ishikawajima Harima) 13 Sep. 1994 abstract.

*Primary Examiner*—Daniel C. Crane

*Attorney, Agent, or Firm*—Antonelli, Terry, Stout, & Kraus, LLP

[57] ABSTRACT

A widthwise-compressing machine for applying a compression force through press tools to a material to reduce a width of the material while applying vibrations to said material to forcibly vibrate said material has a compression unit for producing a compression force forming a working force, and a vibration-applying unit for applying the vibration to said material. The vibration-applying unit is provided independently of the compression unit. In the widthwise-compressing machine, when the material is plastically worked, the material can be vibrated at an extremely high frequency to make it possible to resonate the material, thereby allowing the plastic-deformation thereof to be promoted.

31 Claims, 19 Drawing Sheets

WIDTHWISE COMPRESSING MACHINE AND METHOD USING VIBRATIONS TO REDUCE MATERIAL WIDTH

BACKGROUND OF THE INVENTION

1. Field of the Invention

This invention relates to an apparatus for working a material to reduce its width or its thickness, and more particularly to an apparatus for working a material to reduce its width or its thickness, which apparatus achieves a high accuracy of working, and can be reduced in size.

2. Description of the Related Art

A conventional apparatus for compressing the width of a material is disclosed in, for example, Japanese Patent Unexamined Publication No. 61-262401. In the apparatus of this conventional technique, there is provided a compressive force-applying device in which anvil blocks are located in contact with widthwise sides of the material, and a force is applied to the anvil blocks in a compressing direction while vibrating the anvil blocks. With this compressive force-applying device, the width compression is effected while applying vibrations to the anvil blocks to forcibly vibrate the sheet material. Thus, the width compression is carried out while keeping the thickness of the sheet uniform.

In order to plastically deform a material to compress its width as in the above conventional technique, an extremely large compressive force and an extremely large displacement amount are required. On the other hand, vibrations, applied in order to promote the plastic deformation of the material, are required to provide only a small thrust and a small displacement amount, but need to be produced at a high frequency, and particularly an extremely high frequency is required in order to resonate the material. For example, for hot compressing the width of common steel, a compressive working force of several thousands of tons and a displacement amount of several hundreds of mm are required, and in order to resonate the material, vibrations need to be applied at a high frequency on the order of several kHz.

However, it is difficult to produce the vibration force of a high frequency by load means which applies a large thrust and a large displacement amount, since moving parts of the load means have a large mass. And besides, it is difficult to vibrate the material through the anvil blocks, which are rigid and large in mass, as in the above conventional technique.

Particularly when a fluid pressure cylinder is used as the load means, it is necessary to increase the bore of the cylinder in order to obtain a large thrust, and at the same time its stroke must be increased in order to obtain a large displacement amount. Therefore, the mass of the moving parts including the anvil blocks is large, and besides the volume of an operating fluid in the cylinder is increased, and therefore the natural frequency, determined by compression properties of the operating fluid, the dimensions of the cylinders and piping, and so on, is low. Since the cylinder does not respond at a frequency beyond this natural frequency, the vibration can not be effected at a high frequency, and particularly the vibration can not be effected at a high frequency corresponding to the resonant point.

Namely, it is extremely difficult to achieve the function of the compression means, requiring a large thrust and a large displacement amount, and the function of the vibration-applying means, requiring a high frequency, at the same time by the common load means, and it is impossible to apply vibrations of a high frequency through the anvil blocks.

Therefore, according to the above conventional technique, sufficient vibrations to promote the plastic deformation of the material can not be applied, and particularly it is virtually impossible to resonate the material. Therefore, there has been encountered a problem that the effects, such as the increase of the compression amount, the reduction of the force and energy required for the working and the improved working accuracy, can not be sufficiently achieved.

SUMMARY OF THE INVENTION

It is an object of this invention to provide an apparatus which overcomes the above problems, achieves a high working accuracy, can be reduced in size, and is capable of working a material to compress its width or its thickness.

To achieve the above object, according to the invention, vibration-applying means for applying vibrations to a material is provided separately from compression means for applying a working force to the material.

Widthwise-compressing machines and control methods thereof according to the invention are in accordance with by the following features:

(1) In a widthwise-compressing machine wherein a compressive force is applied to a material through press tools to reduce a width of the material while applying vibrations to the material to forcibly vibrate the material, there is provided compression means for producing the compressive force forming a main working force, and vibration-applying means for applying the vibrations is provided independently of the compression means.

(2) In a widthwise-compressing machine wherein a compressive force is applied to a material through press tools to reduce a width of the material while applying vibrations to the material to forcibly vibrate the material, the compressive force forming a main working force is of a magnitude insufficient to compress the material into a desired width by itself, and vibration-applying means for applying the vibrations is provided independently of the compression means.

(3) In a widthwise-compressing machine wherein a compressive force is applied to a material to reduce a width of the material while applying vibrations to the material to forcibly vibrate the material, there is provided compression means for applying the compressive force, forming a main working force, through the press tools to the material, and vibration-applying means for applying the vibrations not through the press rolls is provided independently of the compression means.

(4) In a widthwise-compressing machine wherein a compressive force is applied to a material to reduce a width of the material while applying vibrations to the material to forcibly vibrate the material, there is provided compression means for applying the compressive force, forming a main working force, through the press tools to the material, and vibration-applying means for applying the vibrations through the press rolls is provided independently of the compression means.

(5) In a control method for the above items (1) to (4), a frequency of the vibrations applied by the vibration-applying means is varied in accordance with a change in size of the material.

(6) In a control method for the above items (1) to (5), the vibration-applying means applies the vibrations of which frequency is close to a resonance frequency of the material.

(7) In any one of the above items (1) to (4), the press tools comprise anvil blocks, respectively.

(8) In any one of the above items (1) to (4), the press tools comprise rotary rolls, respectively.

(9) In a control method for the above items (1) to (4), vibration forces applied by the vibration-applying means are exerted in the same direction as the direction of compression of the width of the material.

(10) In a control method for the above items (1) to (4), vibration forces applied by the vibration-applying means are exerted in a direction different from the direction of compression of the width of the material.

(11) In the control method of the above item (10), the vibration forces applied by the vibration-applying means are exerted in a direction of a thickness of the material.

(12) In the control method of the above item (10), the vibration forces applied by the vibration-applying means are exerted in a direction of travel of the material.

(13) In a widthwise-compressing machine wherein a compressive force is applied to a material through press tools to reduce a width of the material while applying vibrations to the material to forcibly vibrate the material, there is provided compression means for producing the compressive force forming a main working force, and a fluid pressure device, serving as vibration-applying means for applying the vibrations, is provided independently of the compression means.

(14) In a widthwise-compressing machine wherein a compressive force is applied to a material through press tools to reduce a width of the material while applying vibrations to the material to forcibly vibrate said material, there is provided a first fluid pressure device serving as compression means for producing the compressive force forming a main working force, and a second fluid pressure device, serving as vibration-applying means for applying the vibrations, is provided independently of the compression means.

(15) In the above item (14), different operating fluids are used respectively in the first fluid pressure device, serving as said compression means, and the second fluid pressure device serving as the vibration-applying means.

In a rolling mill, in which a rolling load is applied to a material through working rolls to reduce a thickness of the material while applying vibrations to the material to forcibly vibrate the material, there is provided pressing means for producing the rolling load forming a main working force, and vibration-applying means for applying the vibrations is provided independently of the pressing means. Preferably, the vibration-applying means applies the vibrations not through the working rolls.

In rolling facilities, in which there are provided one or more rolling mills for rolling a material to reduce a thickness thereof while applying a rolling load to the material, the rolling facilities includes at least one of a widthwise-compressing machine which has compression means for producing a compressive force forming a main working force, and vibration-applying means which applies vibrations to the material, and is provided independently of the compression means, and the rolling mill which has pressing means for producing a rolling load forming a main working force, and vibration-applying means which applies vibrations to the material, and is provided independently of the pressing means.

The compressive force forming the working force applied to the material by the compression means or the rolling load and the vibration force applied to the material by the vibration-applying means are applied to the material independently of each other. Therefore, the function of the compression means or the pressing means, requiring a large thrust and a large displacement amount, and the function of the vibration-applying means requiring a high frequency can be achieved at the same time. As a result, the material can be worked with high precision.

DETAILED DESCRIPTION OF THE PREFERRED EMBODIMENT

One embodiment of an apparatus of the present invention will now be described with reference to FIGS. 1 and 2.

Figure 1:
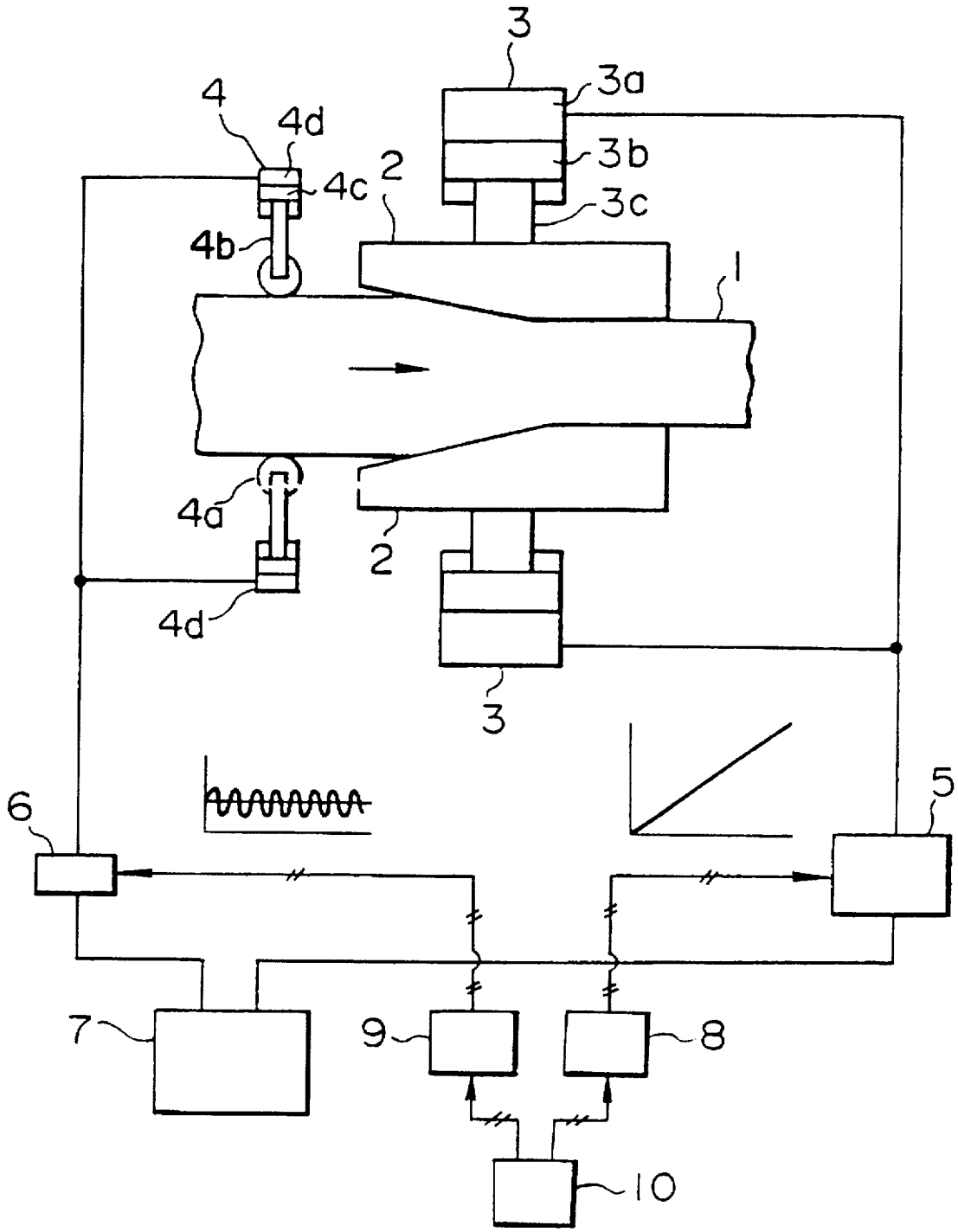
FIG. 1 is a structural view of a widthwise-compressing machine using anvil blocks according to an embodiment of the present invention.

In FIG. 1, reference numeral 1 denotes a material whose width is to be worked or compressed, and in this embodiment this material has a sheet-like form. Reference numeral 2 denotes anvil blocks 2, which constituts press tools, for applying compressive forces (working forces) respectively to side surfaces of the material 1, and reference numeral 3 denotes compression means for reducing the width of the sheet material 1. Each compression means 3 includes a cylinder 3*a*, a piston 3*b* mounted in the cylinder 3*a*, and a piston rod 3*c* connected to a respective one of the anvil blocks 2. The anvil blocks 2 are so arranged as to hold the material 1 therebetween, and the compression means 3 are provided outwardly of the anvil blocks, respectively.

Reference numeral 4 denotes vibration-applying means for applying vibrations directly to the side surfaces of the material 1, respectively. Each vibration-applying means 4 includes a roller 4*a* in contact with the side surface of the material 1, a piston rod 4*b* supporting the roller 4*a*, a piston 4*c*, and a cylinder 4*d*. The rollers 4*a* of the vibration-applying means 4 are provided independently of the compression means 3 at the inlet side for the material 1 in the anvil blocks 2. At least two sets of vibration-applying means 4 are provided at the inlet side of the anvil blocks 2 so as to hold the material 1 therebetween.

The pistons 3*b* of the compression means 3 are controlled by a control valve 5, and the pistons 4*c* of the vibration-applying means 4 are controlled by a control valve 6. The control valves 5 and 6 are connected to a power unit 7 which supplies an operating fluid to the control valves 5 and 6, and receives the operating fluid discharged therefrom.

The control valves 5 and 6 are driven respectively by control instructions fed respectively from controllers 8 and 9. The controllers 8 and 9 are controlled by a host controller 10. As shown in FIG. 1, the compression means 3 are driven by the control valve 5 controlled by a monotonic signal. The vibration-applying means 4 are driven by the control valve 6 controlled by an oscillation signal.

For hot compressing the width of the material 1 made, for example, of common steel, a large compressive working force of several thousands of tons and a large displacement amount of several hundreds of mm are required, and therefore the bore and stroke of the cylinder 3*a* of the compression means 3 need to be increased.

On the other hand, the vibration to be applied to the material 1 can be small in force and displacement amount, but need to have a high frequency of several kHz in order to resonate the material.

With the above construction, the compressive force or the rolling load serving as the working force, and the vibration force for vibrating the material 1 which totally differ in required properties can be applied to material 1, respectively.

The reason is that the construction can be made most suitable in the dimensions and specification, as well as the driving and control systems, for achieving the required performance. A fluid pressure mechanism for the compression means or the pressing means and a fluid pressure mechanism for the vibration-applying means can be designed into respective suitable constructions independently of each other. As described later, the compression means 3 or the pressing means is constituted by an electrically-operated mechanism having a crankshaft mechanism, and the vibration-applying means 4 is constituted by a fluid pressure mechanism using a cylinder. Alternatively, systems most suitable for various requirements can be used in combination. For example, the compression means 3 or the pressing means can be constituted by a fluid pressure mechanism, and the vibration-applying means 4 can be constituted by an electrically-operated mechanism using a crankshaft mechanism, a cam mechanism or a link mechanism.

For example, the compression means 3 or the pressing means and the vibration-applying means 4 are constituted by fluid pressure mechanisms, respectively, and if the compression means 3 or the pressing means requiring a large thrust and a large displacement amount uses a system in which the cylinder, having a large bore and a large stroke, is controlled by the control valve having high pressure and a high flow rate while the vibration-applying means 4 requiring a high frequency uses a system in which the cylinder, having a small stroke, is controlled by the high-response control valve, the following operation is effected:

The natural frequency $f_n$ of the fluid pressure mechanism which vibrates the load with a mass M by the cylinder having a pressure-receiving area A is expressed by formula 1 if the sum of the volume of the operating fluid in the cylinder and the volume of the operating fluid in a pipe extending from the control valve to the cylinder is represented by V, and the bulk modulus of the operating fluid is represented by K.

$$f_n = \frac{1}{2\pi}\sqrt{\frac{4A^2K}{vM}} \quad (1)$$

The pressure-receiving area A is large since the compression means or the pressing means requires a large thrust, and therefore the required flow rate is high, and in order to reduce a pressure loss, the diameter of the pipe is large, so that the volume in the pipe extending from the control valve and the cylinder is large. And, since the stroke is large in order to obtain a large displacement amount, the volume in the cylinder is large. As a result, the sum V of the volume of the operating fluid in the cylinder and the volume of the operating fluid in the pipe extending from the control valve to the cylinder is large, and the mass M is large. Therefore, the natural frequency $f_n$ of the fluid pressure mechanism is small.

On the other hand, if the vibration-applying means 4 are provided independently, the thrust and stroke can be small, and therefore the mass M is small, and the sum V of the volume of the operating fluid in the cylinder and the volume of the operating fluid in the pipe extending from the control valve to the cylinder is small. Therefore, the natural frequency $f_n$ of the fluid pressure mechanism can be increased. Therefore, there can be achieved the vibration-applying means capable of vibrating the material at an extremely high frequency corresponding to the resonance frequency of the material.

Further, if the vibration-applying means 4 are provided separately from the compression means 3 or the pressing means, and the material is vibrated not through press tools and working rolls having a large mass, then the mass of the moving parts of the vibration-applying means 4 can be made smaller. Therefore, the natural frequency can be made higher, and the limit value of the frequency of the applied vibration is further enhanced, so that the vibration can be effected at a higher frequency. For example, if the required thrust in the vibration-applying means of the width-compressing apparatus using the anvil blocks is 1/10 of the thrust required in the means for effecting both compression and vibration in the conventional technique, and the stroke is 1/50, then the pressure-receiving area A is 1/10, and the sum V of the volume of the operating fluid in the cylinder and the volume of the operating fluid in the pipe is 1/500.

Therefore, if the mass of the moving parts is 1/30, the natural frequency $f_n$ of the fluid pressure mechanism is about twelve times higher. Actually, in accordance with the decrease of the required flow rate, the diameter of the pipe is decreased, and the volume in the pipe extending from the control valve to the cylinder is decreased, and therefore the sum V of the volume of the operating fluid in the cylinder and the volume of the operating fluid in the pipe is further decreased, so that the natural frequency $f_n$ of the fluid pressure mechanism becomes higher. Therefore, the natural frequency $f_n$ of the fluid pressure mechanism can be made higher several tens of times or more, and the limit vibration frequency is greatly increased.

If Young's modulus of the material is represented by E, and its density is represented by ρ, the resonance frequency $f_W$ in the direction of the width of the sheet is expressed by formula 2. For example, the resonance frequency $f_W$ of a material (which has a sheet width of 1200 mm, and is to be hot processed) in the direction of the width of the sheet is about 1.6 kHz. Therefore, if the limit vibration frequency which has heretofore been up to about 100 Hz at best is increased as described above, the material can be resonated.

$$f_W = \frac{1}{2W}\sqrt{\frac{E}{\rho}} \tag{2}$$

On the other hand, if the area of contact between the anvil block and the sheet material is represented by S, a strain $\epsilon_C$ at a widthwise central portion of the sheet and a strain $\epsilon_E$ at the side edge portion of the sheet are expressed respectively by formula 3 and formula 4 when an elastic vibration force Psin(2πft) (where P represents a half amplitude of the elastic vibration force, f represents the frequency of the applied vibration, and t represents time) is applied to the material having a sheet width W.

$$\epsilon_C = \frac{P}{AE\cos\left(\frac{2\pi f}{\sqrt{\frac{E}{\rho}}}\cdot\frac{W}{2}\right)}\sin(2\pi ft) \tag{3}$$

-continued $$\epsilon_E = \frac{P}{AE}\sin(2\pi ft) \tag{4}$$

Figure 2:
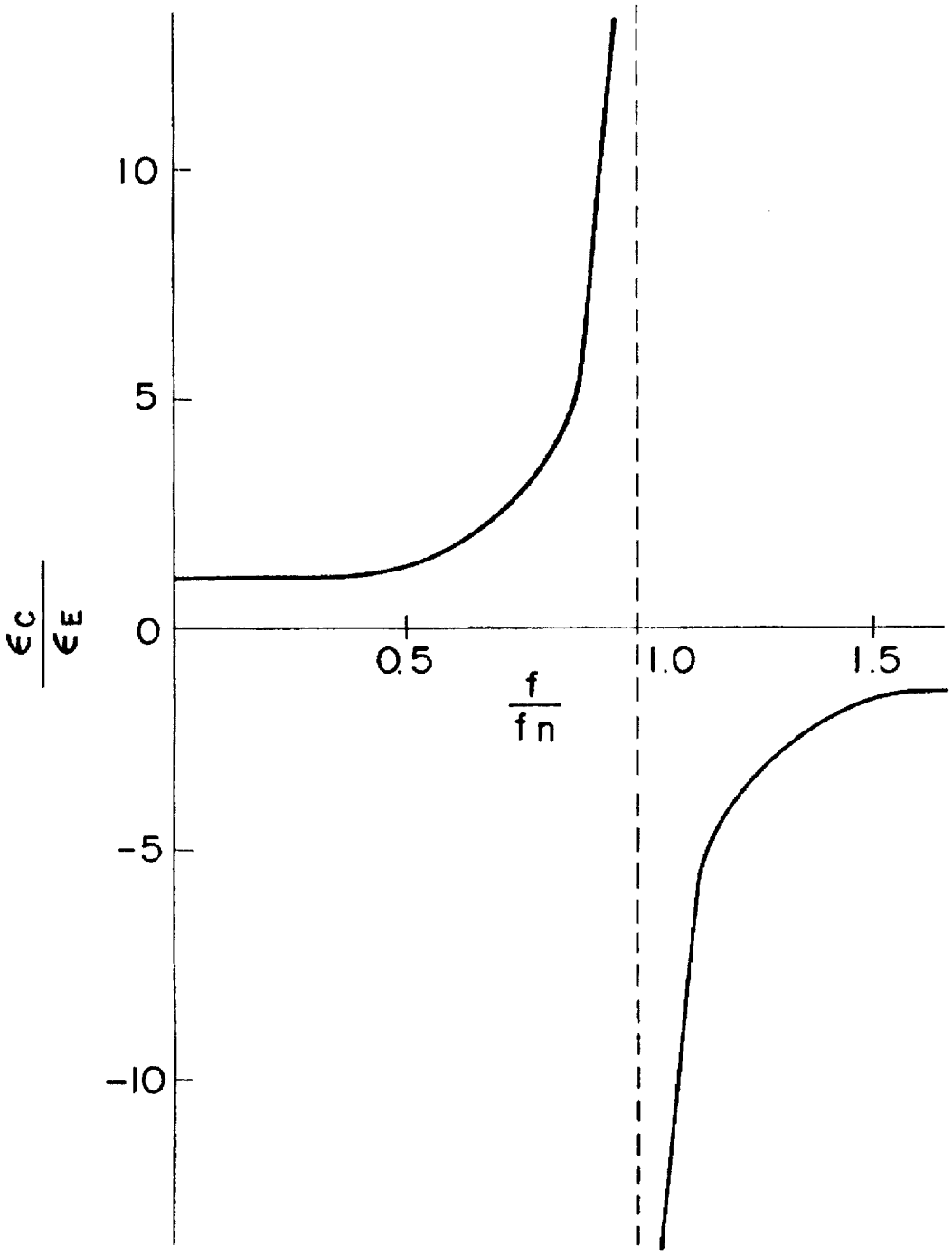
FIG. 2 is a characteristic diagram of a change of the ratio of a dynamic strain at a sheet end to a dynamic strain at a central portion of the sheet in accordance with a frequency of applied vibrations.

Therefore, the ratio of the strain $\epsilon_C$ at the central portion of the sheet to the strain $\epsilon_E$ at the sheet side edge portion is expressed by formula 5, and varies relative to the ratio of the frequency f of the applied vibration to the resonance frequency $f_W$ as shown in FIG. 2.

$$\frac{\epsilon_C}{\epsilon_E} = \frac{1}{\cos\left(\frac{2\pi f}{\sqrt{\frac{E}{\rho}}}\cdot\frac{W}{2}\right)} \tag{5}$$

Namely, as the frequency f of the applied vibration becomes closer to the resonance frequency $f_W$ in the direction of the width of the sheet, the dynamic strain at the central portion of the sheet becomes larger as compared with the strain at the sheet side edge portion. The larger the dynamic strain is, the more easily the deformation goes beyond the elastic range when the compressive force is applied from the compression means, so that plastic deformation is liable to occur.

Therefore, as the frequency f of the applied vibration becomes closer to the resonance frequency $f_W$ in the direction of the width of the sheet, the plastic deformation at the central portion of the sheet becomes more promoted, so that the plastic deformation does not localize on the sheet side edge portions, but is uniform. This enhances the working precision of the width compression.

Figure 3:
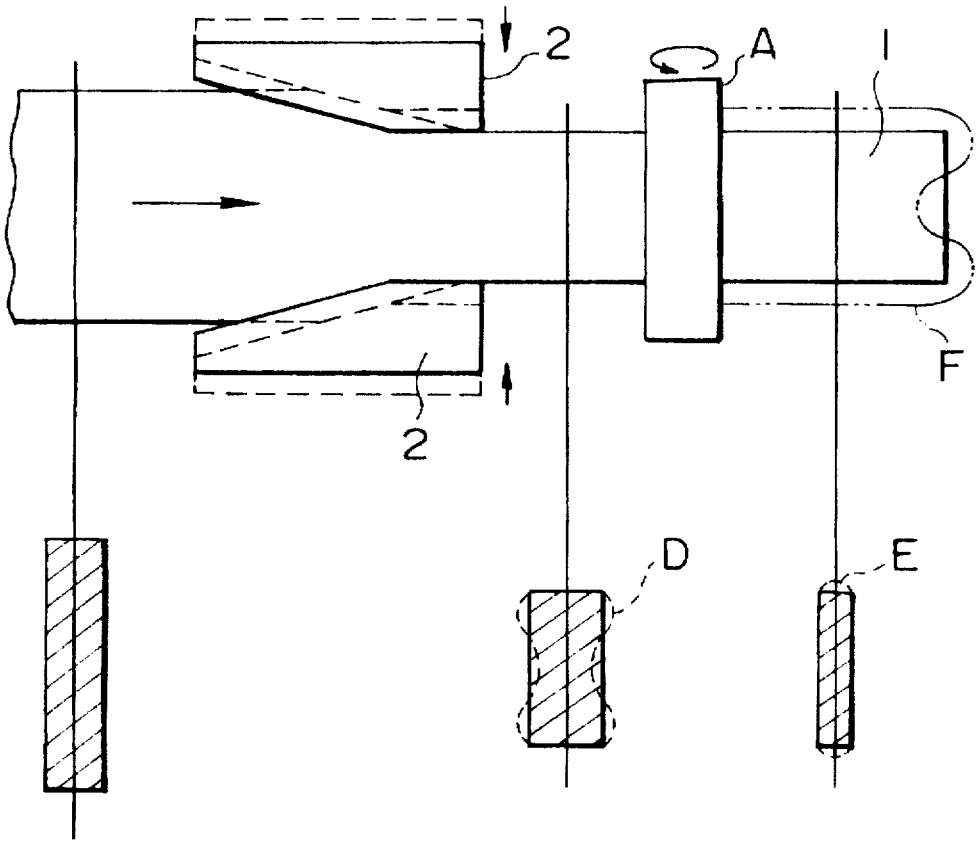
FIG. 3 is an illustration of an operation of the widthwise-compressing machine using anvil blocks according to the present invention.

As a result, a dog bone phenomenon D, in which the sheet thickness after the width compression is larger at the sheet side edge portions than at the central portion of the sheet as shown in FIG. 3 is less liable to occur, and a width return phenomenon E, in which the thickened side edge portion of the sheet is caused to flow outwardly to increase the sheet width during rolling by the rolling mill A at a later stage, is also less liable to occur. Therefore, the working precision after the rolling is enhanced, is also less.

Further, an improper shape, such as a fish-tail F developing at leading and trailing ends of the material, is less liable to occur, so that a crop loss is reduced, and the yield is increased.

The compression means 3 or the pressing means and the vibration-applying means 4 may use different operating fluids, respectively, and therefore if the vibration-applying means 4 uses the operating fluid greater in the bulk modulus K than the operating fluid for the compression means or the pressing means, the limit frequency of the vibration produced by the vibration-applying means 4 can be further increased.

Moreover, a surge pressure Δp, abruptly produced, for example, upon striking of the material against the press tools and the working rolls, can be reduced because the surge pressure Δp, expressed by formula 6, increases with the increase of K, so that the surge pressure Δp can be reduced if the compression means or the pressing means use the operating fluid having a small value of k.

$$\Delta p = \rho\sqrt{\frac{k}{\rho}}\cdot\Delta v \tag{6}$$

Thus, in the present invention, the material 1 can be vibrated at a higher frequency, and can be vibrated at an extremely high frequency close to the resonance frequency of the material. Therefore, the effect of promoting the plastic deformation by the vibration is enhanced, so that the material can be plastically deformed more uniformly.

Therefore, the compression amount or the pressing amount increases, and the force and energy required for the working can be reduced, and the widthwise-compressing machine and the rolling mill can be reduced in size, and the working precision can be enhanced.

The natural frequency $f_n$ of the fluid pressure mechanism is represented by the above formula 1, and the cylinder will not respond at a frequency above this natural frequency, so that the displacement amount decreases. The compression means 3 has the large pressure-receiving area A and the large stroke, so that the volume of the cylinder is large. In addition, since the required flow rate is high, the diameter of the pipe is large so as to reduce the pressure loss, and the sum V of the volume of the operating fluid in the cylinder and the volume of the operating fluid in the pipe from the control valve to the cylinder is extremely large.

Further, since there are provided the anvil blocks as press tools which are rigid and have a large mass, the mass M is large. Therefore, in the compression means 3, the natural frequency $f_n$ of the fluid pressure mechanism is low, and the material 1 can not be vibrated at such a high frequency as to resonate the material 1.

However, in this embodiment, the vibration-applying means 4 are provided independently of the compression means 3, and further vibrations are applied not through the anvil blocks 2, and therefore the bore and stroke of the cylinder **4*d* of the vibration-applying means 4** can be reduced, and the sum V of the volume of the operating fluid in the cylinder and the volume of the operating fluid in the pipe from the control valve to the cylinder, as well as the mass M, can be reduced, so that the natural frequency $f_n$ of the fluid pressure mechanism can be increased.

Therefore, the material 1 can be vibrated at such an extremely high frequency that the material can be resonated. This promotes the plastic deformation, so that the sheet material 1 is deformed uniformly up to the central portion thereof.

Figure 4:
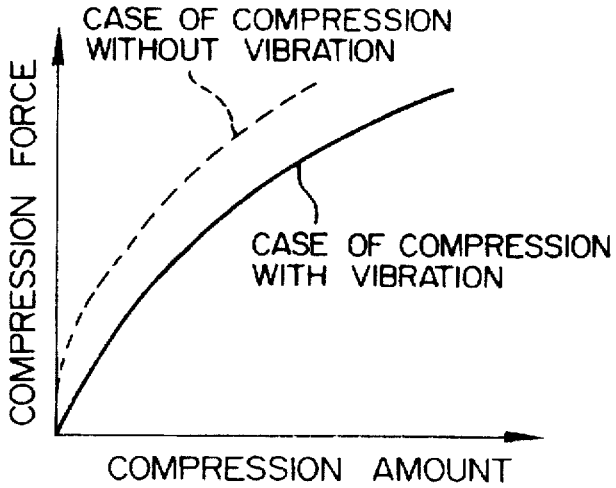
FIG. 4 is a characteristic diagram of a relation between a compression amount and a compressive force in the widthwise-compressing machine of FIG. 3.

Characteristics indicated in a broken line in FIG. 4 are obtained when compressing the material without applying vibrations thereto, whereas characteristics indicated in a solid line are obtained when compressing the material while vibrating the same at a high frequency.

Namely, when the material 1 is compressed while being vibrated at a high frequency, the compressive force required for achieving the same compression amount is smaller as compared with the case of compressing the material without vibrations. Therefore, there can be realized the width-compressing machine in which the compression amount can be increased, and the force and energy required for the working can be reduced, and the size of the machine can be smaller than the conventional machine. And, the working precision of the sheet width is enhanced. Particularly, the material is deformed uniformly up to the central portion thereof without causing the dog bone phenomenon, in which the deformation concentrates on those portions of the material near to the anvil blocks, thus thickening these portions, so that the sheet thickness after the width compression is uniform. Therefore, the width return phenomenon is less liable to occur at a later rolling step, and the precision of the sheet width after the rolling operation is enhanced, and further the leading and trailing end portions of the processed material having an undesirable shape such as a fish-tail shape are shortened. Therefore, the yield is improved.

Figure 5:
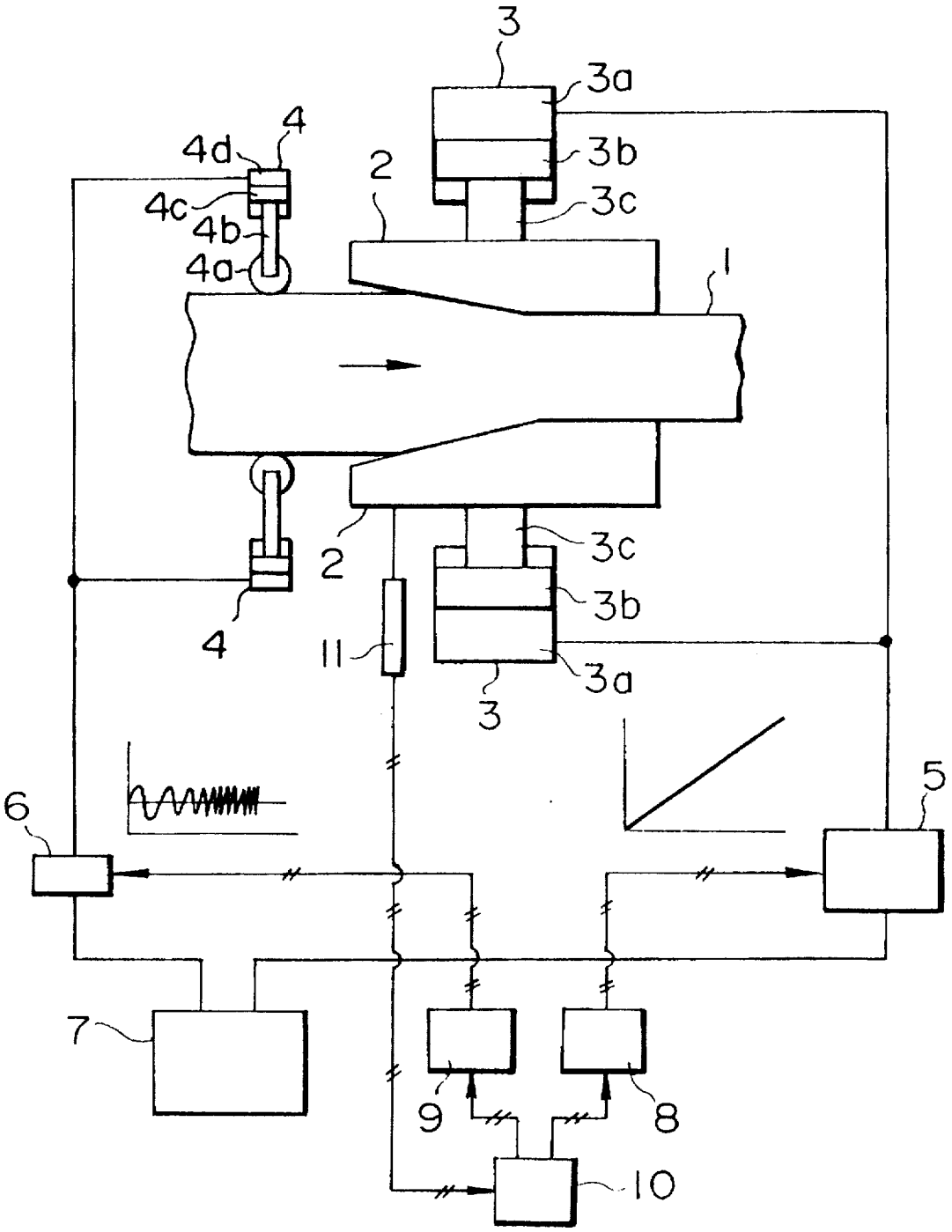
FIG. 5 is a structural view of a widthwise-compressing machine using anvil blocks according to another embodiment of the present invention.

FIG. 5 shows another embodiment of an apparatus of the invention. The same reference numerals in FIGS. 1 and 5 denote identical or corresponding parts, respectively. This is the same with the other Figures showing the following embodiments of the invention. In this embodiment, the amount of compression of a material 1 is detected by a displacement sensor 11 provided on one of anvil blocks 2, and is fed back to a host controller 10. In accordance with the increase of the compression amount to narrow the sheet width, the host controller 10 controls a controller 9 of vibration-applying means and pistons **4*c* of the vibration-applying means 4** so that the frequency of the vibration can increase.

The resonance frequency increases with the decrease of the sheet width of the material 1. However, in this embodiment, the frequency of the applied vibration can be varied in accordance with the change of the resonance frequency due to the change of the sheet width, so that the material is always kept in a proper condition and preferably in a resonant condition during the widthwise-compressing operation. Therefore, the effects, such as the increase of the compression amount, the reduction of the force and energy required for the working, and the improved working precision, can be further enhanced.

Figure 6:
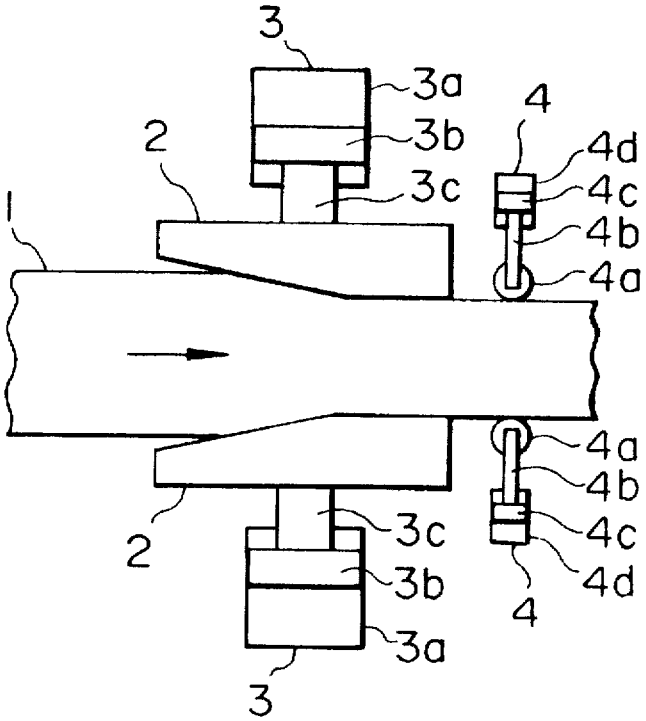
FIG. 6 is a structural view of a widthwise-compressing machine using anvil blocks according to a further embodiment of the present invention.

FIG. 6 shows a further embodiment of an apparatus of the invention in which rollers **4*a* of vibration-applying means 4 are provided downstream of anvil blocks 2 in a direction of supply of a material 1**. In this embodiment, similar effects as described in the above embodiments are achieved.

Figure 7:
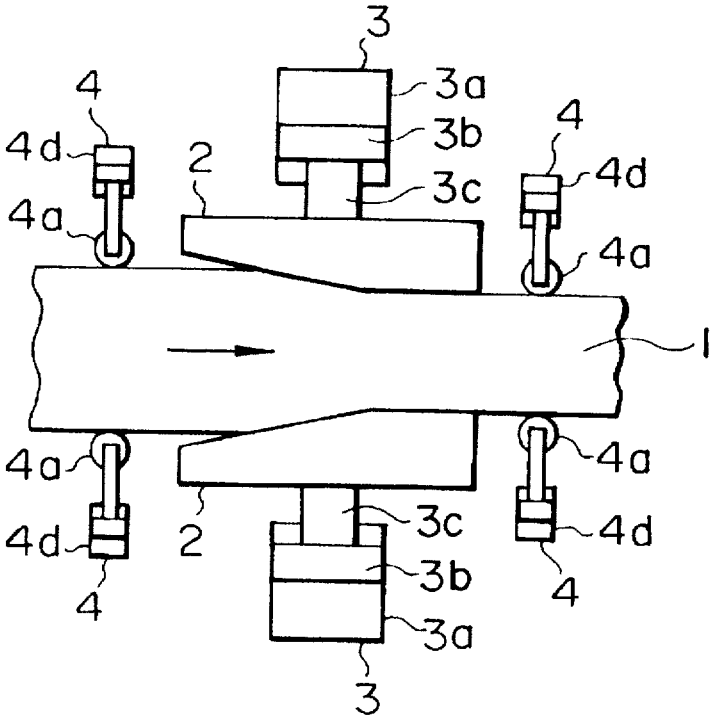
FIG. 7 is a structural view of a widthwise-compressing machine using anvil blocks according to yet another embodiment of the present invention.

FIG. 7 shows yet another embodiment of an apparatus of the invention in which two pairs of vibration-applying means 4 are provided upstream and downstream of anvil blocks 2, respectively. In this embodiment, similar effects as described in the above embodiments are achieved.

Figure 8:
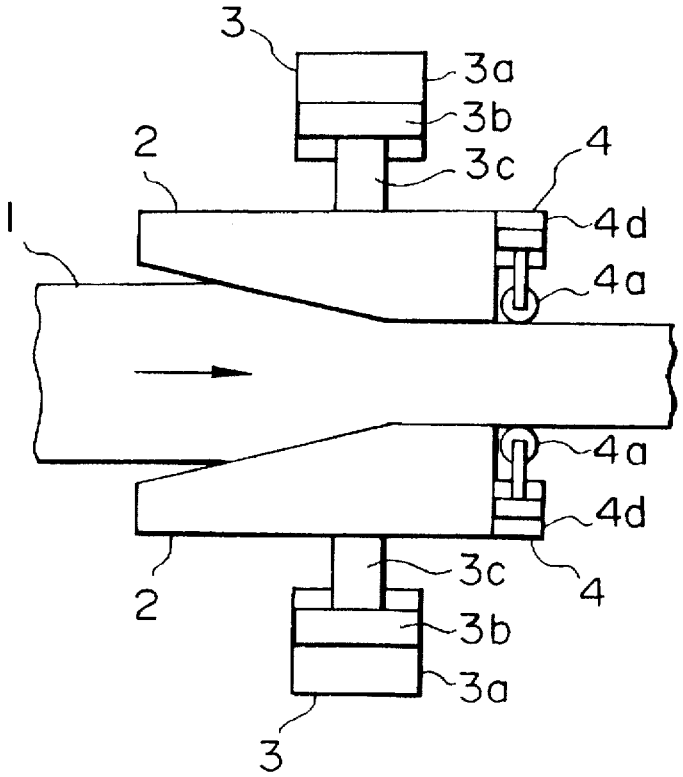
FIG. 8 is a structural view of a widthwise-compressing machine using anvil blocks according to a still further embodiment of the present invention.

FIG. 8 shows a still further embodiment of an apparatus of the invention in which cylinders **4*d* of vibration-applying means 4 are fixedly mounted on downstream-side ends of anvil blocks 2**, respectively. In this embodiment, similar effects as described in the above embodiment are achieved.

Figure 9:
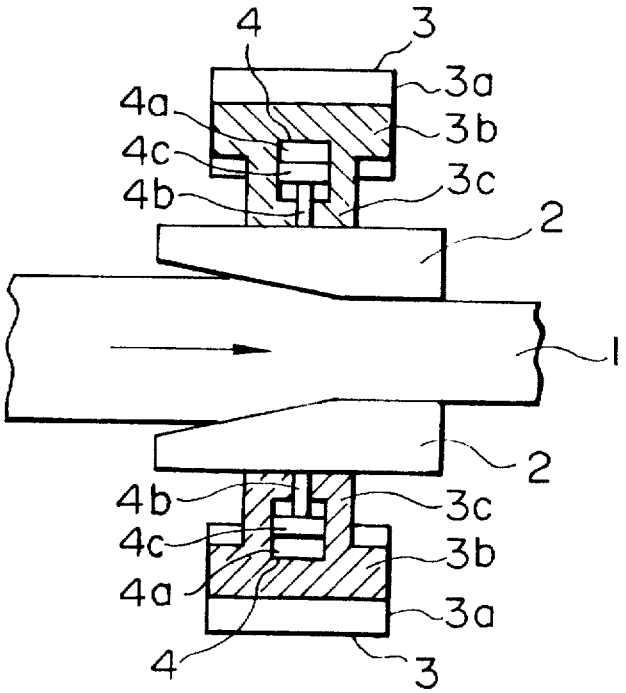
FIG. 9 is a structural view of a widthwise-compressing machine using anvil blocks according to an additional embodiment of the present invention.

FIG. 9 shows an additional embodiment of the invention in which each of vibration-applying means 4 is incorporated or built in a piston **3*b* and a piston rod 3*c* of a respective one of compression means 3**. In this embodiment, similar effects as described in the above embodiments are achieved, and the structural parts of the apparatus can be arranged in a compact manner, so that the size of the apparatus can be reduced more effectively.

Figure 10:
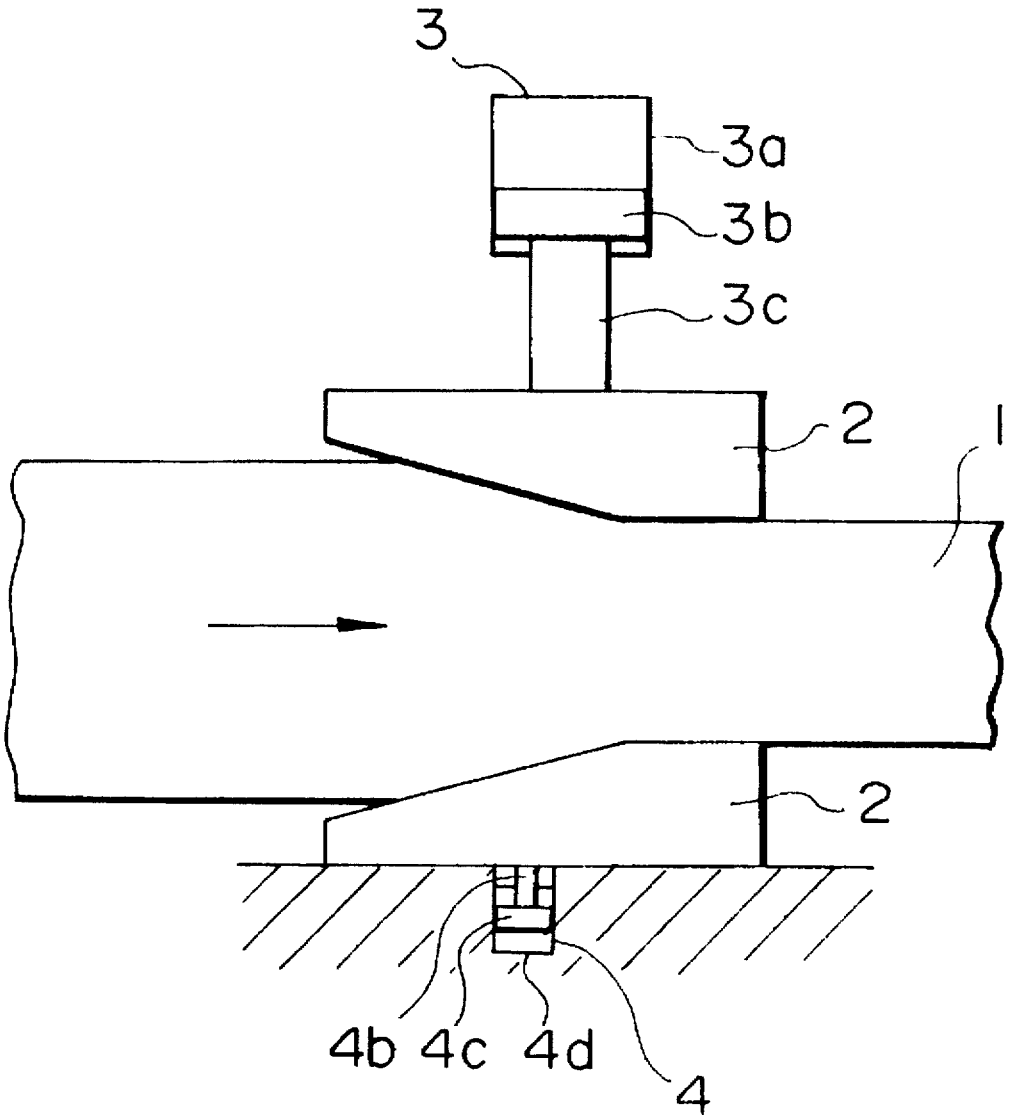
FIG. 10 is a structural view of a widthwise-compressing machine using anvil blocks, only one of which is movable, according to another embodiment of the present invention.

FIG. 10 shows another embodiment of an apparatus of the invention in which one anvil block 2 is movable while the other anvil block 2 is fixed, and compression means 3 is connected to the movable anvil block 2, and vibration-applying means 4 is mounted on the fixed anvil block 2. In this embodiment, similar effects as described in the above embodiments are achieved.

Figure 11:
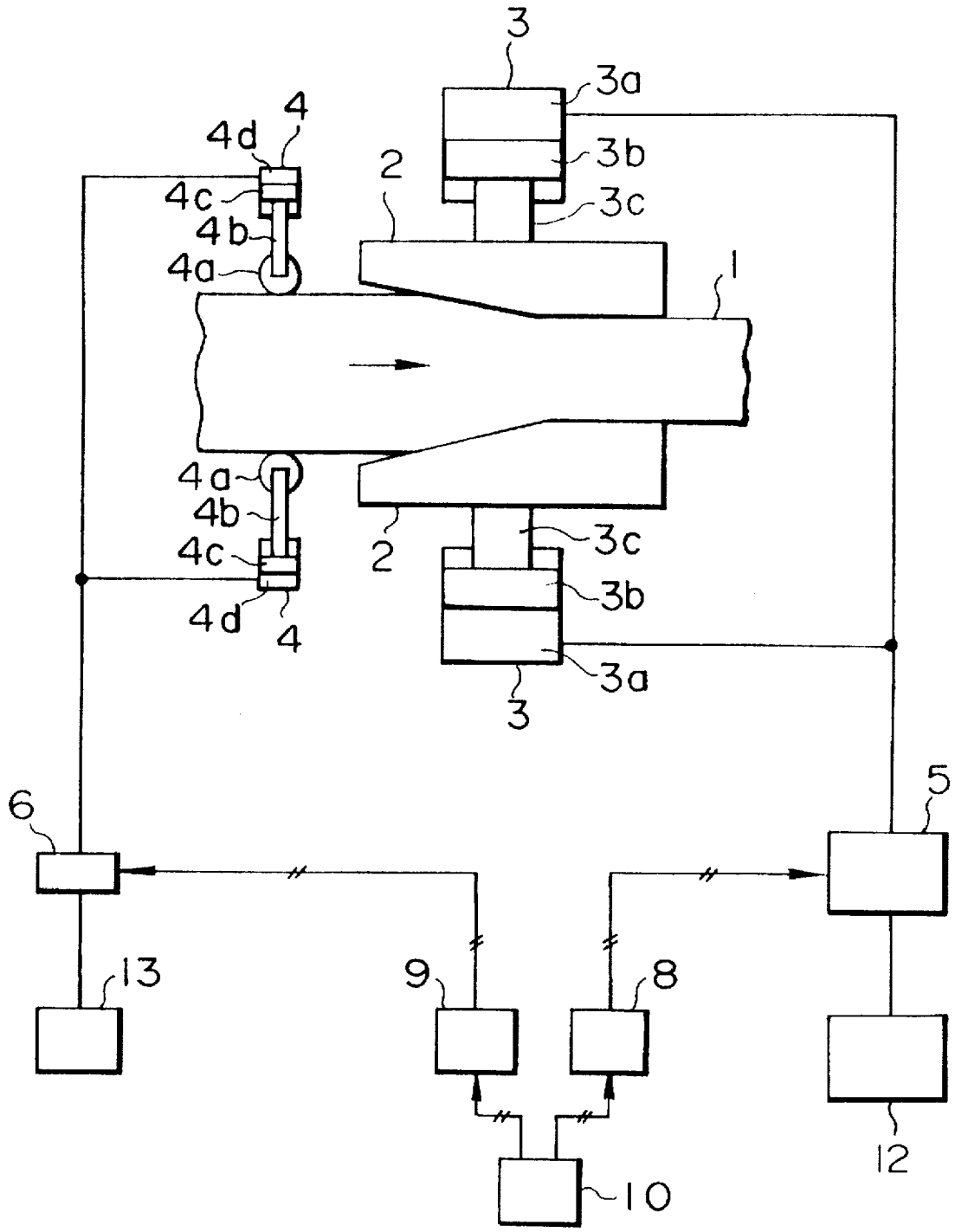
FIG. 11 is a structural view of a widthwise-compressing machine using anvil blocks according to a further embodiment of the present invention.

FIG. 11 shows a further embodiment of an apparatus of the invention in which a power unit 12 for compression means 3 and a power unit 13 for vibration-applying means 4 are provided separately from each other, and the compression means 3 and the vibration-applying means 4 are incorporated respectively in two fluid pressure circuits independent of each other. Different operating fluids are used in the two independent fluid pressure circuits, and with this arrangement the following effects are achieved.

Firstly, if the operating fluid for the vibration-applying means 4 is larger in K, i.e. the bulk modulus, than the operating fluid for the compression means 3, the natural frequency $f_n$, representing the limit vibration frequency of the vibration-applying means 4, can be further increased. Secondly, a surge pressure $\Delta p$, abruptly produced upon striking of the press tools 2 against the material 1, is expressed by the above formula 2, and the larger the value of K is, the higher this surge pressure is. Therefore, if the operating fluid having a small value of K is used for the compression means 3, the surge pressure Δp, abruptly produced upon striking of the press tools 2 against the material 1, can be reduced, so that the lifetime of the apparatus can be prolonged.

The vibration-applying means in all of the above embodiments are of such a construction that the operating fluid, supplied from the power unit to the cylinder and discharged from the cylinder to the power unit, is controlled by the control valve, thereby controlling the movement of the anvil block or blocks. However, instead of the power unit and the control valve, there can be used a vibration fluid pressure-generating source such as a kind of pump which alternately effects the suction and discharge of the operating fluid by mechanical movement achieved by a rotating drive source such as an electric motor. The control valve or the vibration fluid pressure-generating source may be connected to each of cylinders **4*d* of the vibration-applying means 4, or may be connected to one of the cylinders 4*d***.

Figure 12:
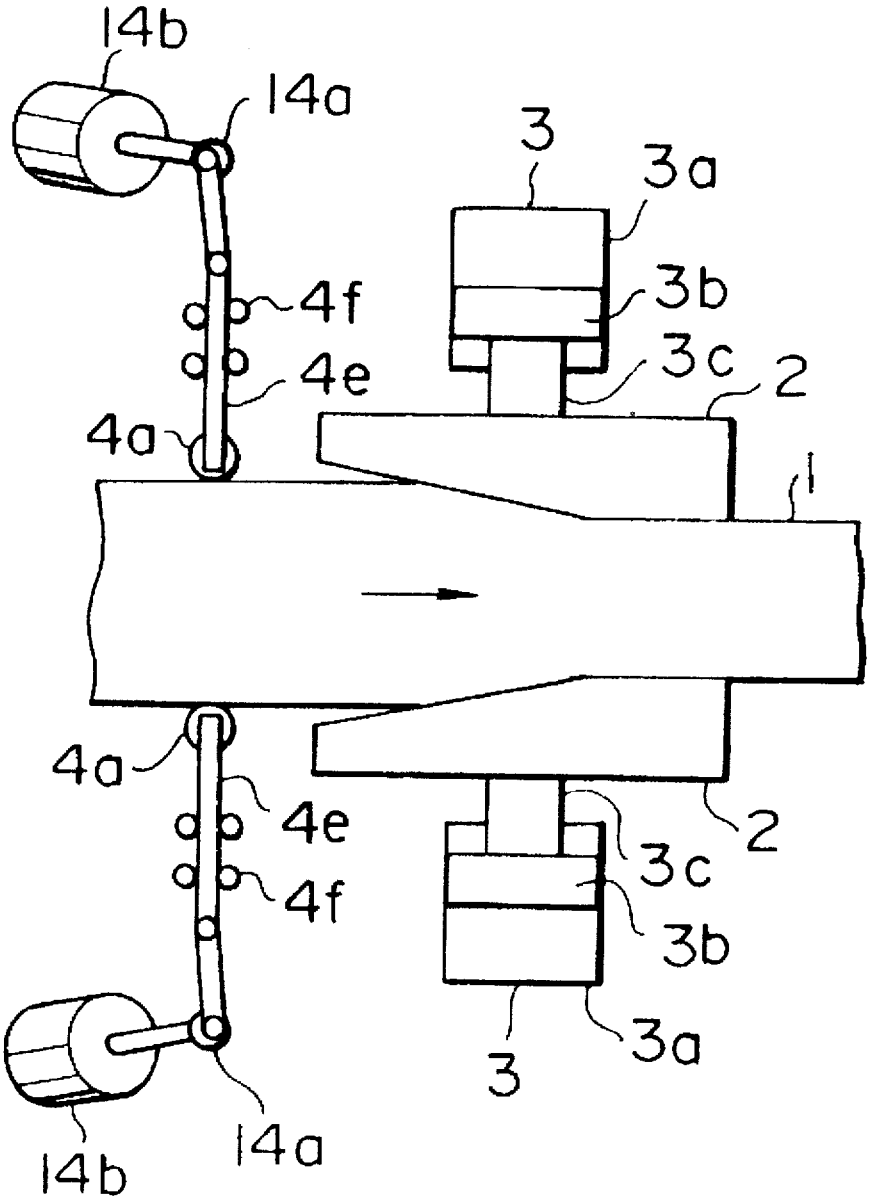
FIG. 12 is a structural view of a widthwise-compressing machine using anvil blocks according to yet another embodiment of the present invention.

FIG. 12 shows yet another embodiment of an apparatus of the invention in which a mechanism for driving each of rollers **4*a*, disposed so as to hold a material 1 therebetween, of vibration-applying means 4 comprises a support member 4*e* supporting the roller 4*a*, guide means 4*f* for guiding the support member 4*e*, a crankshaft mechanism 14*a*, and a drive motor 14*b* for driving the crankshaft mechanism 14**. In this embodiment, similar effects as described in the above embodiments are achieved.

Figure 13:
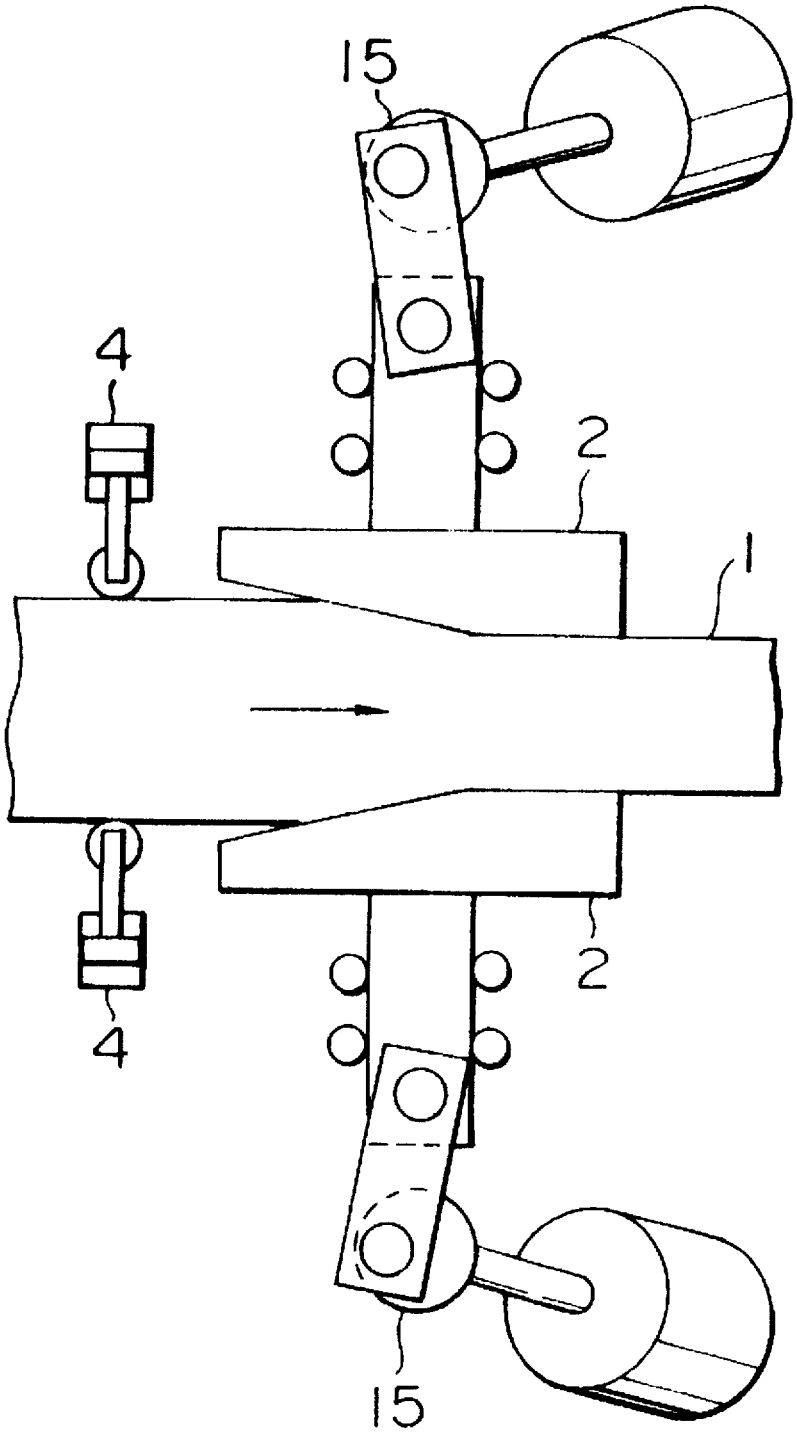
FIG. 13 is a structural view of a widthwise-compressing machine using anvil blocks according to a still further embodiment of the present invention.
Figure 14:
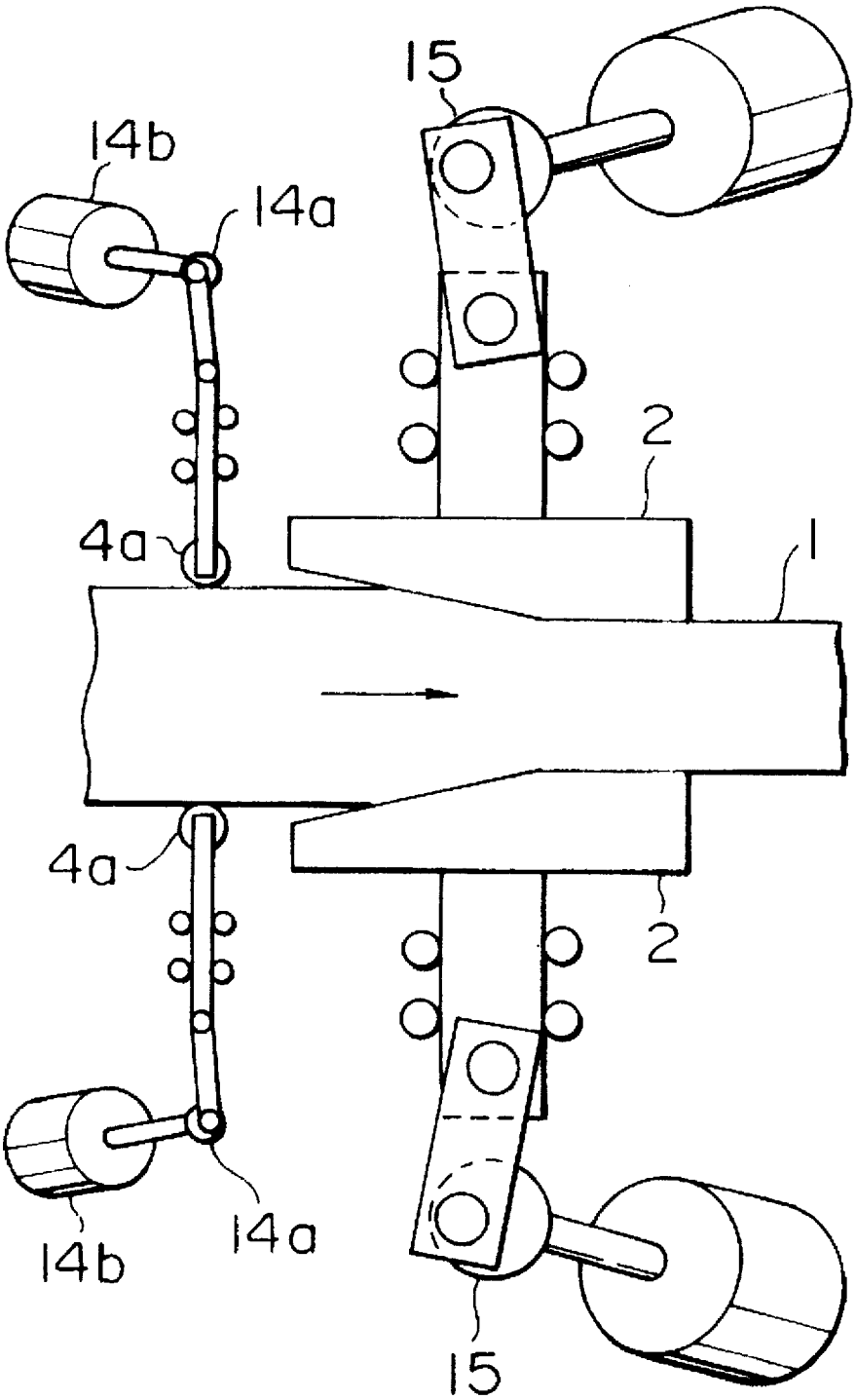
FIG. 14 is a structural view of a widthwise-compressing machine using anvil blocks according to an additional embodiment of the present invention.

FIG. 13 shows a still further embodiment of an apparatus of the invention in which each of a pair of compression means 3 comprises a crankshaft mechanism 15. The vibration-applying means and the compression means may comprise crankshaft mechanisms 14 and 15, respectively, as shown in FIG. 14, and may comprise any other suitable mechanisms. With the use of such mechanisms, if the vibration-applying means and the compression means are provided independently of each other so as to provide a small thrust, small-stroke construction, the limit vibration frequency of the vibration-applying means can be increased. Therefore, the plastic deformation is further promoted, effects, such as the increase of the compression amount, the reduction of the force and energy required for the working, the compact design of the apparatus, and the improvement of the working precision, can be obtained as in the above embodiments.

Figure 15:
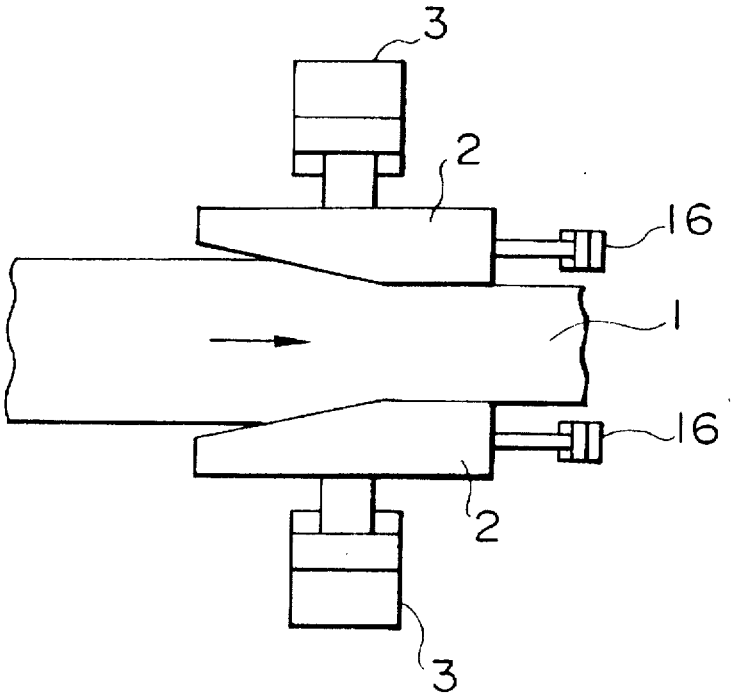
FIG. 15 is a structural view of a widthwise-compressing machine using anvil blocks, showing one example of a method of applying the vibration, according to the present invention.

Vibration-applying means 16 may be so provided as to vibrate the material in a direction of travel of the material, as shown in FIG. 15. With this arrangement, widthwise components of the vibration forces act on the material through opposed slanting side surfaces of two anvil blocks 2, and therefore similar effects as describe in the above embodiments are achieved. The vibration force may be applied to the material through the anvil blocks as in this embodiment. When the material 1 has a relatively wide sheet width, the resonance frequency is relative low, and therefore even if the material is vibrated together with the anvil blocks 2, similar effects due to the plastic deformation as described above are achieved.

Figure 16:
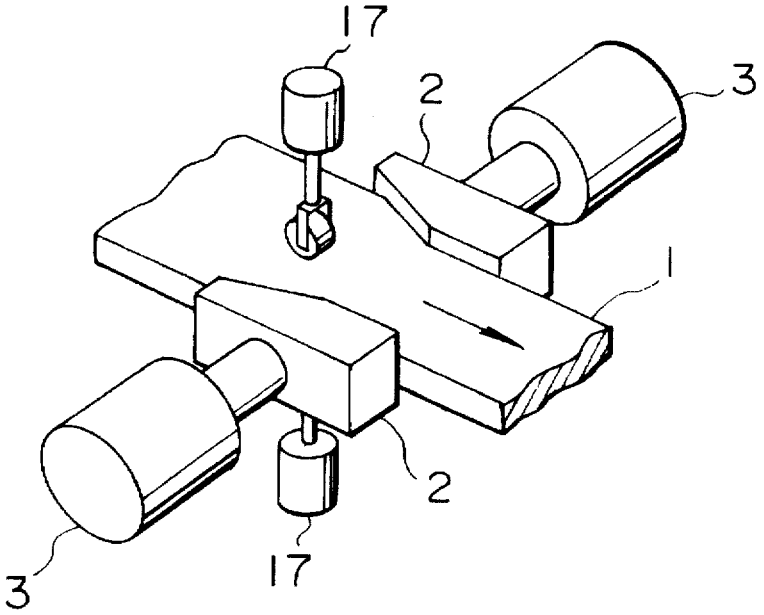
FIG. 16 is a structural view of a widthwise-compressing machine using anvil blocks, showing another example of a method of applying the vibration, according to the present invention.

Vibration-applying means 17 may be so provided as to vibrate the material in a direction of the thickness of the material, as shown in FIG. 16. With this arrangement, vibrations propagate in the material in various directions, thus producing widthwise components of the vibration forces, and therefore similar effects as described above are achieved. In this embodiment, the vibration-applying means are provided respectively on the upper and lower sides of the material, and anvil blocks 2 are held respectively against lateral side edges or surfaces of the material 1, and compression means 3 are disposed outwardly of the anvil blocks 2, respectively.

Figure 17:
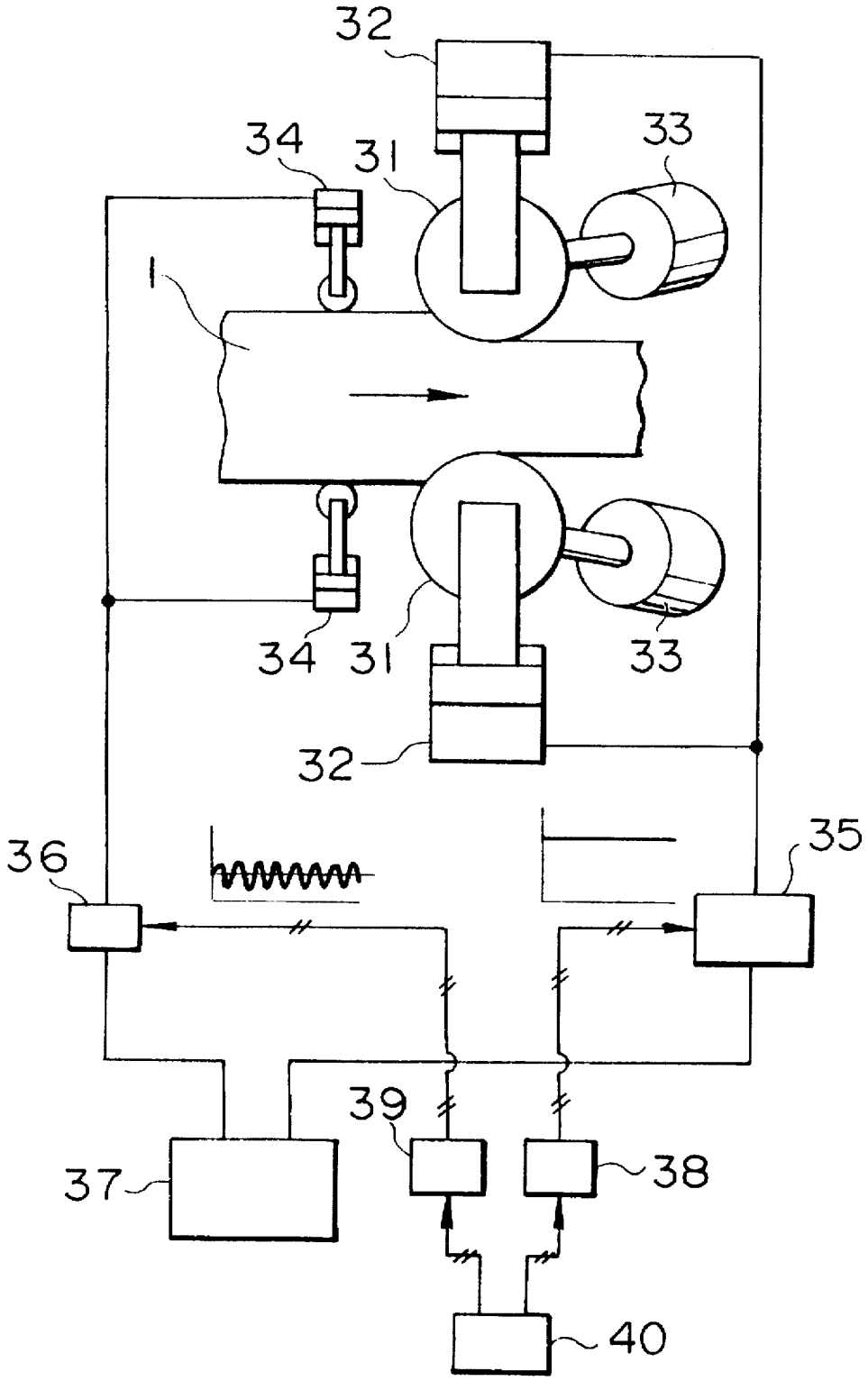
FIG. 17 is a structural view of a widthwise-compressing machine using rotary rolls according to another embodiment of the present invention.

Another preferred embodiment of a widthwise-compressing machine of the invention is shown in FIG. 17.

In this embodiment, press tools for compressing the width of a material 1 comprises rotary rolls 31, and the rotary rolls 31 are so arranged as to hold the material 1 therebetween. The other portions are the same as described in the embodiment of FIG. 3. More specifically, in this width-compressing machine, the pair of rotary rollers 31 are rotated by respective rotation drive devices 33 while applying forces, produced by cylinders 32 constituting compression means through the rotary rolls 31 to the material 1 in the direction of the width of the material.

In addition to these compression means, there are provided cylinders 34, which serve as vibration-applying means, for applying vibrations to the material 1 not through the rotary rolls 31. The cylinders 32 are controlled by a control valve 35, and the cylinders 34 are controlled by a control valve 36.

There is provided a power unit 37 which supplies an operating fluid to the control valves 35 and 36, and receives the operating fluid therefrom. The control valves 35 and 36 are controlled respectively by control instructions fed respectively from controllers 38 and 39. The controllers 38 and 39 are controlled by a host controller 40. As shown in FIG. 17, a monotonic signal is fed to the cylinders 32 serving as compression means, and an oscillation signal is fed to the cylinders 34 serving as vibration-applying means.

In this embodiment, also, the vibration-applying means are provided independently of the compression means as in the above embodiments using the anvil blocks, and the material can be vibrated at such a high frequency that the material can be resonated. Therefore, plastic deformation of the material is promoted by the applied vibrations, and the increase of the compression amount, the reduction of the force and energy required for the working, the compact design of the apparatus, and the improvement of the working precision can be enhanced.

Particularly, there have heretofore been used rotary rolls as press tools, and the compression amount could not be increased, and also the dog bone phenomenon has been liable to occur. If the thus compressed material is rolled at a later stage, there has been encountered a problem that large width return and fish-tail have occurred. In this embodiment, however, the material can be vibrated at a high frequency to thereby promote the plastic deformation thereof, so that the material can be compressed uniformly in a large amount. Therefore, such problems can be overcome.

Figure 18:
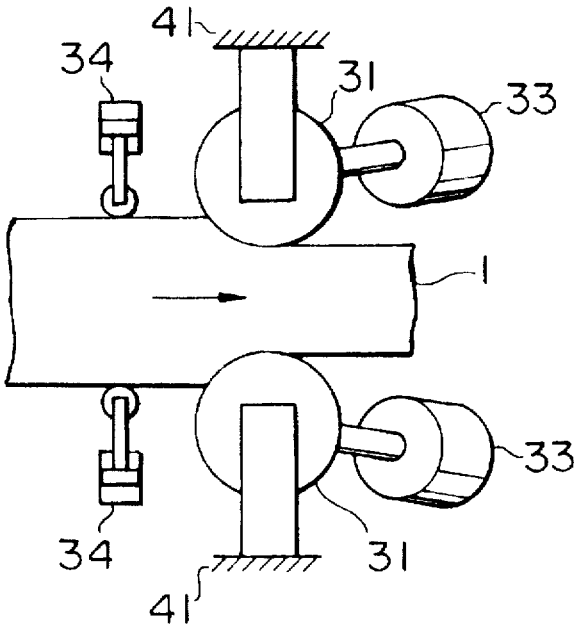
FIG. 18 is a structural view of a widthwise-compressing machine using rotary rolls according to another embodiment of the present invention.

As shown in FIG. 18, the rotary rolls 31 may be fixedly mounted on support bases 41, respectively, and the compression of the material is effected utilizing reaction forces from the support bases 41. This construction is the same as that of FIG. 17 in that rotation drive devices 33 are connected to the rotary rolls 31, respectively.

Figure 19:
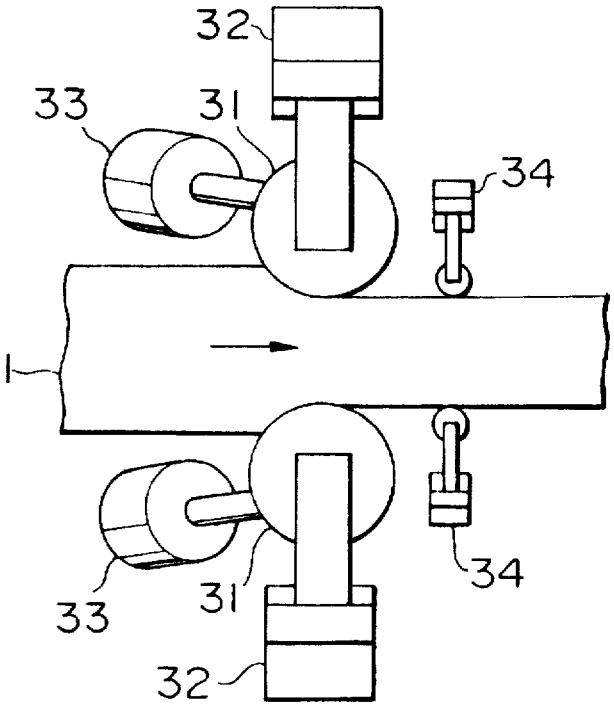
FIG. 19 is a structural view of a widthwise-compressing machine using rotary rolls according to a further embodiment of the present invention.
Figure 20:
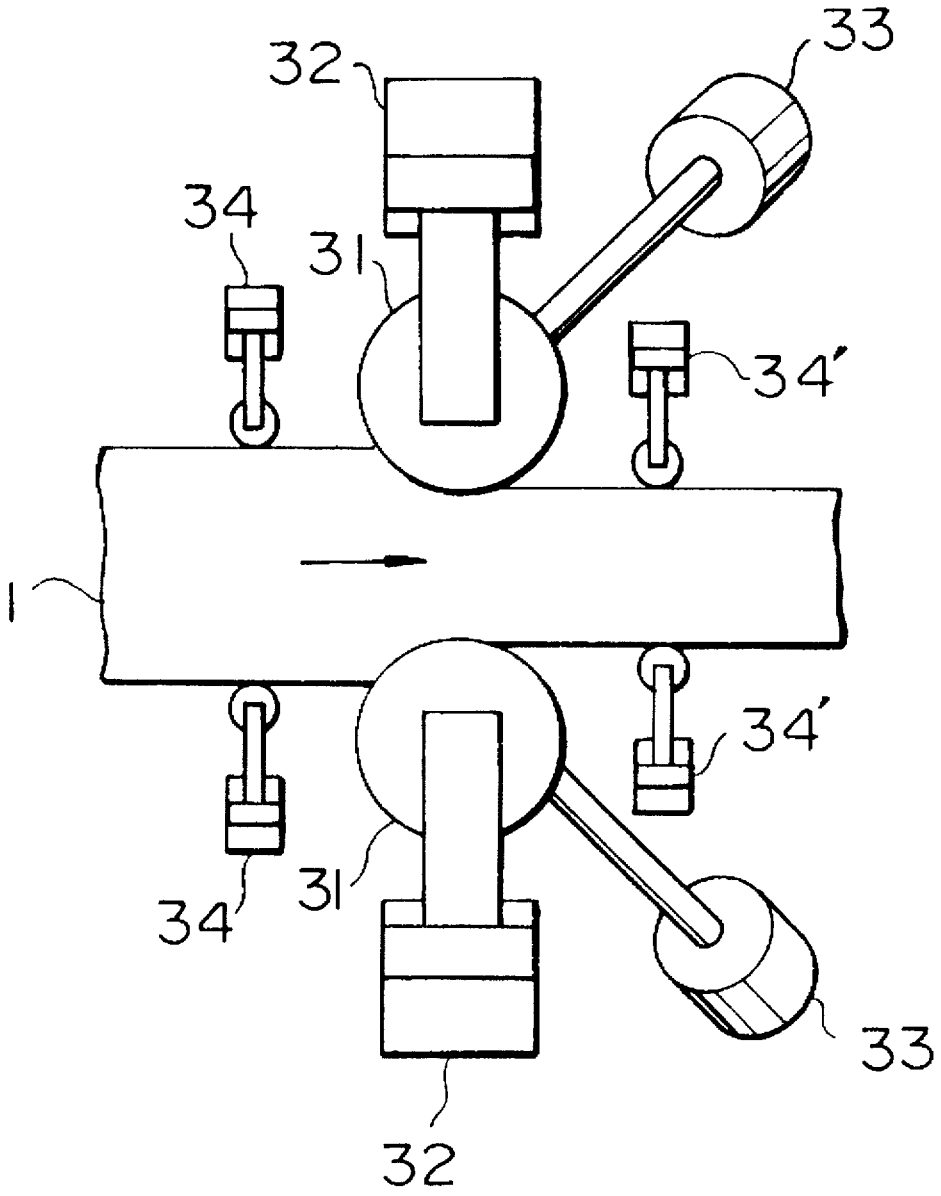
FIG. 20 is a structural view of a widthwise-compressing machine using rotary rolls according to yet another embodiment of the present invention.

The cylinders 34 of the vibration-applying means may be provided downstream of the rotary rolls 31 of the compression means as shown in FIG. 19. Also, in addition to the cylinders 34 provided upstream of the rotary rolls 31, another pair of cylinders 34' as vibration-applying means 34' may be provided downstream of the rotary rolls 31, as shown in FIG. 20.

Figure 21:
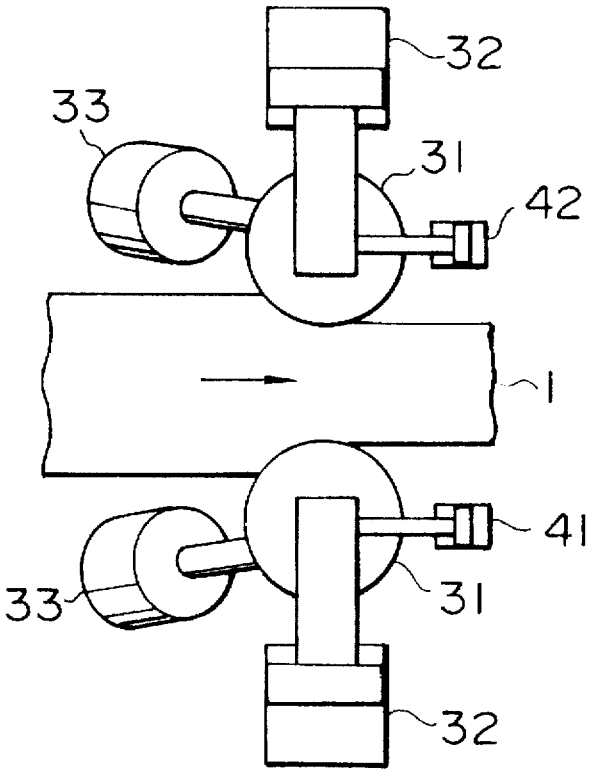
FIG. 21 is a structural view of a widthwise-compressing machine using rotary rolls according to a still further embodiment of the present invention.
Figure 22:
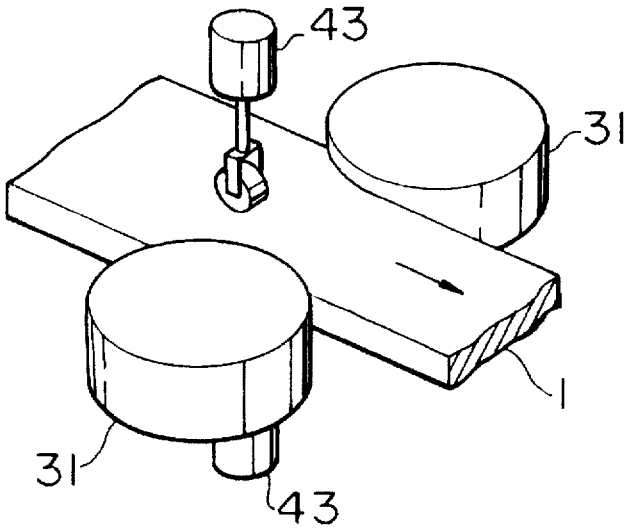
FIG. 22 is a structural view of a widthwise-compressing machine using rotary rolls according to an additional embodiment of the present invention.

Cylinders 42 of vibration-applying means may be so provided as to vibrate the material in the direction of travel of the material, as shown in FIG. 21. Also, cylinders 43 of vibration-applying means may be so provided as to vibrate the material in the direction of the thickness of the material, as shown in FIG. 22.

With such constructions, similar effects as obtained in the above embodiments using the anvil blocks are achieved.

Figure 23:
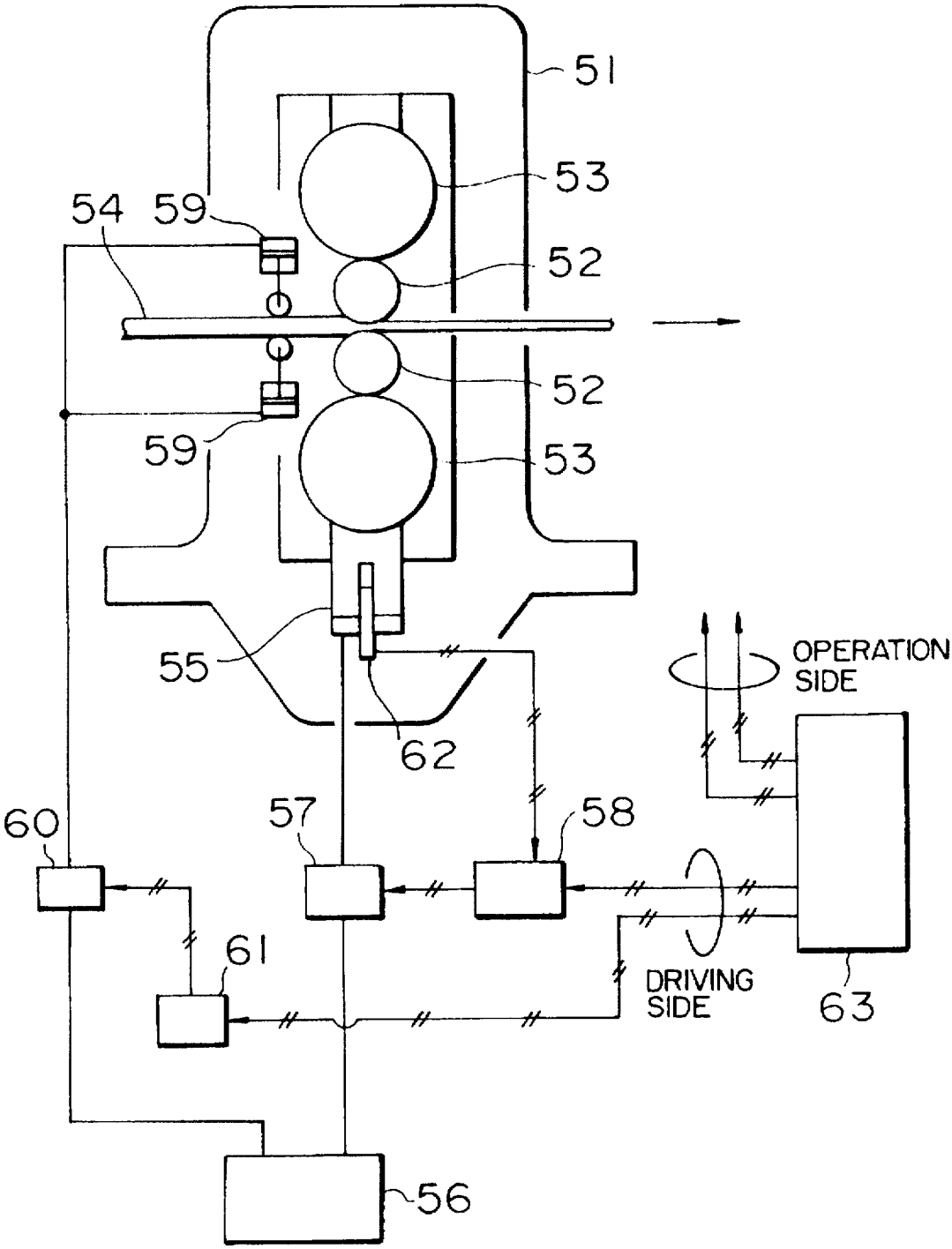
FIG. 23 is a structural view of a rolling mill according to the present invention.

A preferred embodiment of a rolling mill of the present invention will now be described with reference to FIG. 23.

The rolling mill 51 includes a cylinder 55 as pressing means which applies a rolling load, which forms a main working force, to a material 54 through a pair of upper and lower auxiliary rolls 53 and a pair of upper and lower working rolls 52. A power unit 56 supplies an operating fluid to the cylinder 55 of the pressing means, and receives the operating fluid from the cylinder 55. A control valve 57 controls the flow of this operating fluid, and a controller 58 feeds a control instruction to the control valve 57.

Cylinders 59 as vibration-applying means for applying vibrations to the material 54 are provided at an upstream side of the rolling mill 51. A control valve 60 controls the flow of the operating fluid supplied to and discharged from the cylinders 59. A controller 61 feeds a control instruction to the control valve 60.

A displacement amount sensor 62 is provided on the cylinder 55 of the pressing means, and an output signal from this sensor is fed back to the controller 58 so as to position the cylinder 55, thereby controlling a gap between the upper and lower working rolls 52 for holding the sheet-like material 54. The pair of cylinders 55 of the pressing means, as well as the pair of control valves 57, the pair of controllers 58 and the pair of displacement amount sensors 62, are provided at the operation side and drive side of the rolling mill 51, respectively. The two controllers 58 for the pressing means provided respectively at the operation side and the drive side, as well as the controller 61 for the vibration-applying means, are controlled by a host controller 63 so that the material 54 can be rolled to be reduced into a desired thickness, thus providing a rolled product.

In this embodiment, the vibration-applying means are provided independently of the pressing means as in the above embodiments of the width-compressing machines, so that the material can be vibrated at a high frequency. Since the thickness of the sheet-like material is smaller than the width thereof, the resonance frequency of the material is very high in the direction of the sheet thickness. However, by the use of the vibration-applying means of this embodiment, the material can be vibrated at a frequency closer to the resonance frequency than in the conventional construction, thereby enabling the effect of promoting plastic deformation to be enhanced. Therefore, the increase of the pressing amount, the reduction of the rolling load and energy, the compact design of the apparatus and the precision of the sheet thickness can be enhanced.

In conventional constructions, the diameter of working rolls need to be small in order to increase the pressing amount, so that there has been encountered a problem that the working rolls are liable to deflection in a horizontal direction, thus lowering the performance. In the rolling mill of this embodiment, however, an increased pressing amount can be obtained even with the use of the working rolls larger in diameter than the working rolls of the conventional apparatus. This advantageously overcomes the lowering of the quality due to deflection of the working rolls.

The cylinders 59 of the vibration-applying means may be provided at the downstream side of the rolling mill 51. Also, in addition to the cylinders 59 provided at the upstream side of the rolling mill 51, another pair of cylinders may be provided at the downstream side. With such constructions, similar effects as described above are achieved.

A preferred embodiment of rolling facilities of the present invention will now be described with reference to FIG. 24.

A slab 102*a*, continuously produced by a continuous casting machine 101, is treated by a heating/heat-retaining device 103 into a condition suited for hot plastic working, and then is fed to a widthwise-compressing machine 104 where the slab 102 is reduced in width into a slab 102*b* smaller in width than the slab 102*a*. Then, the slab 102*b* is greatly reduced in thickness by coarse rolling mills 105, and then is rolled by finish rolling mills 106 into a final thickness to provide a strip 102*c*.

Then, the strip 102*c* is cooled by a cooling device 107, and is wound into a coil-like configuration by a down-coiler 108, and is cut by a cutter 109 into a predetermined length to provide a final product. The widthwise-compressing machine 104 has the same construction as that shown in FIG. 3, and includes vibration-applying means 110 for applying vibrations to the material or slab, the vibration-applying means 110 being provided at an upstream side independently of compression means for applying a main working force to the material.

In this embodiment, in the widthwise-compressing machine 104, the plastic deformation of the slab is promoted by the vibrations applied by the vibration-applying means 110, so that the slab is deformed uniformly up to the widthwise central portion of the slab. Therefore, a dog bone phenomenon is less liable to occur, and width return and fish tail are less liable to occur upon rolling, and therefore the precision and quality of the rolled product, as well as the yield, are enhanced.

Since the widthwise-compressing machine 104 can achieve a large amount of compression, the time required for compressing the material to the desired width can be shortened, and the overall production ability of the rolling equipment is enhanced. And besides, the range of adjustment of the sheet width by the widthwise-compressing machine 104 is wide, and therefore the frequency of exchange of casting dies of the continuous casting machine 101 can be reduced, and the operating efficiency of the equipment can be enhanced. Furthermore, the width-compressing machine 104 requires small energy for working the material, and therefore the running cost can be reduced. Since the width-compressing machine 104 is of a small or compact size, the overall length of the equipment can be reduced, and the installation cost can be reduced.

Figure 25:
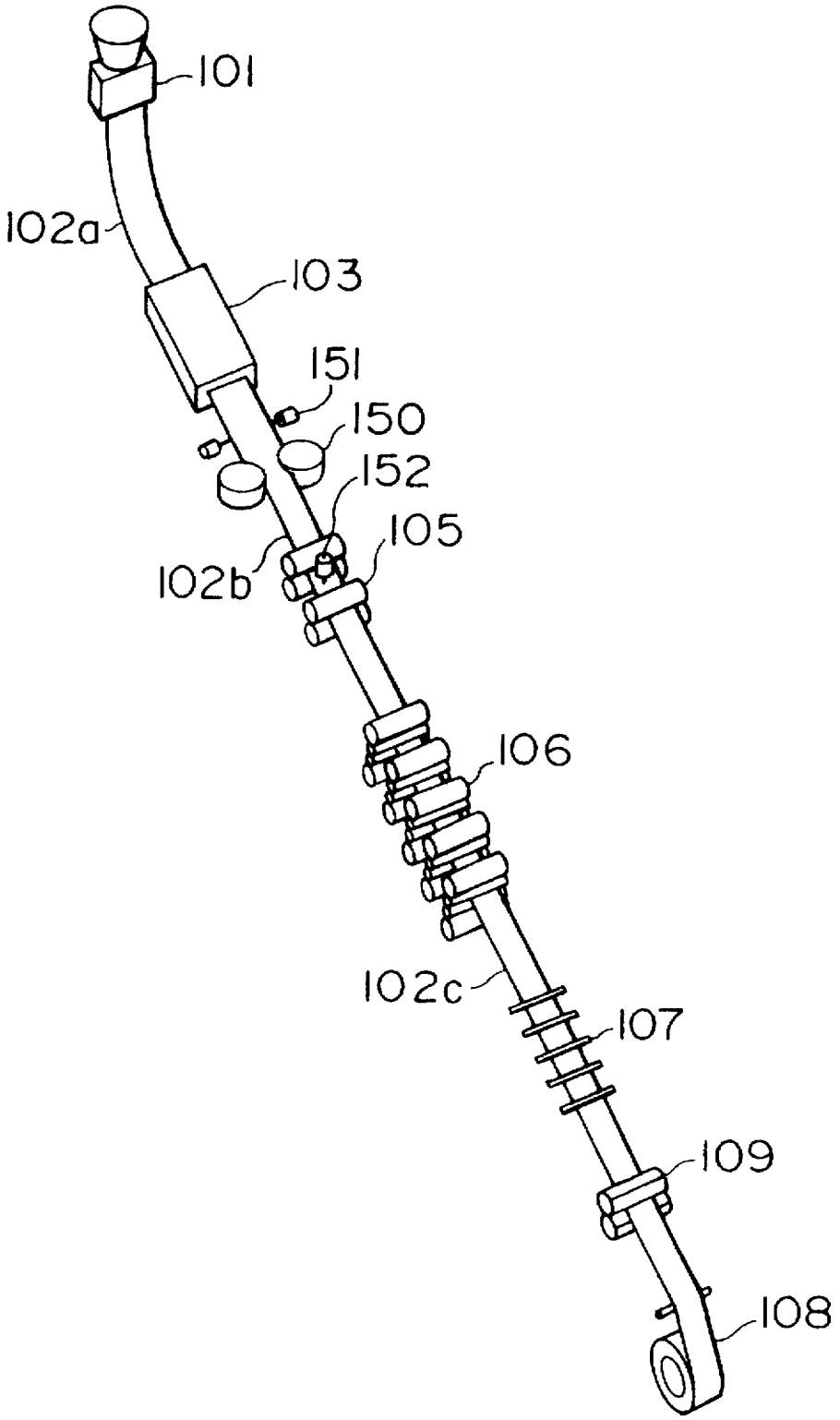
FIG. 25 is a structural view of rolling facilities according to another embodiment of the present invention.

Finally, another preferred embodiment of rolling facilities of the invention will now be described with reference to FIG. 25.

Figure 24:
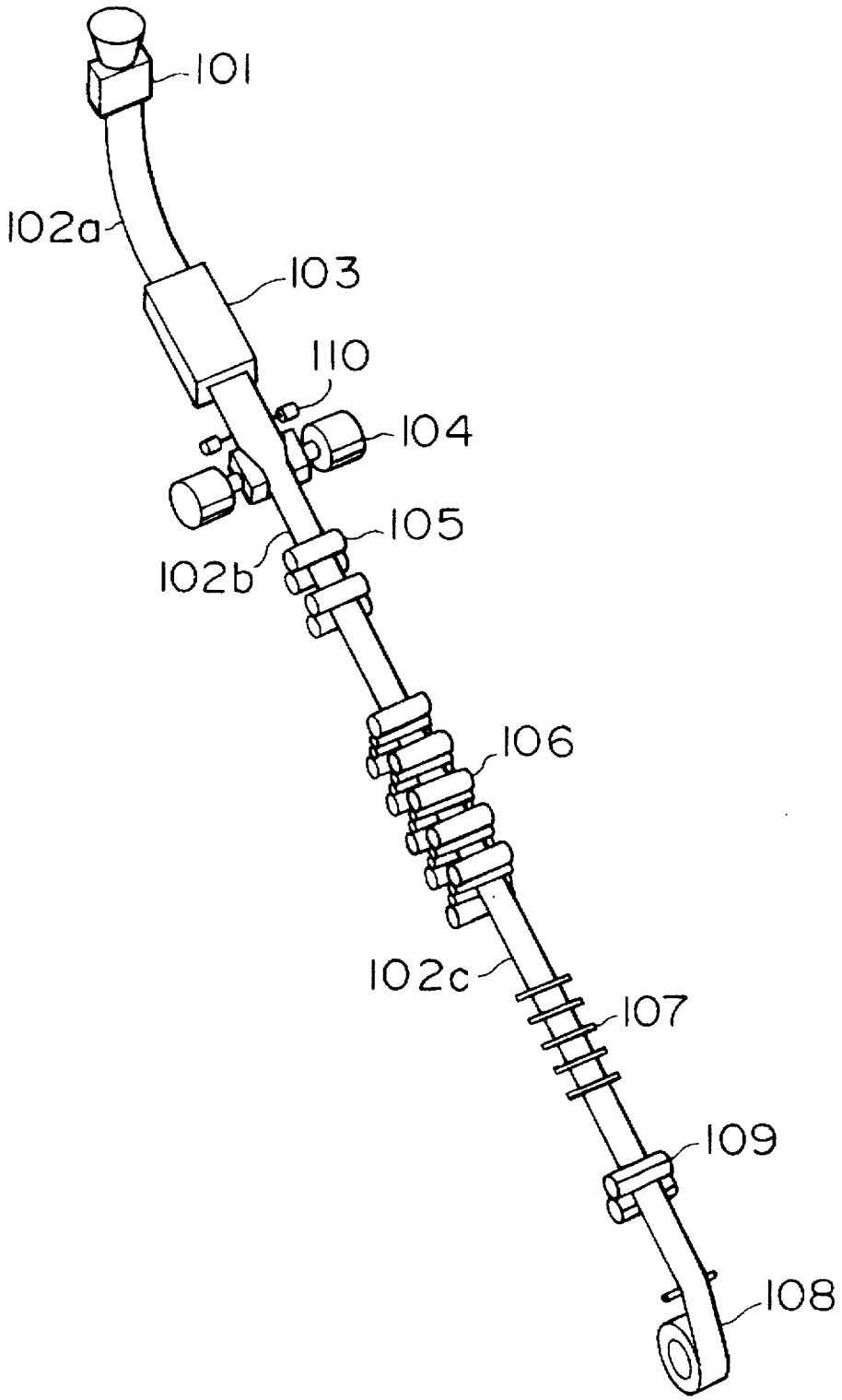
FIG. 24 is a structural view of a rolling facilities according to an embodiment of the present invention.

In this embodiment, steps of a production process, i.e. a continuous casting step, a heating/heat-retaining step, width-compressing step, a coarse rolling step, a finish rolling step, a cooling step, a cutting step and a winding step, are carried out in the same order as in the preceding embodiment of FIG. 24. The rolling facilities of this embodiment differ from the preceding embodiment in that a width-compressing machine comprises an edger in which the sheet width is adjusted or reduced by rotary rolls, that vibration-applying means 151 are provided at an upstream side of the width-compressing machine, and that vibration-applying means 152 are provided between a pair of coarse rolling machines 105.

In this embodiment, under the effect of vibrations produced by the vibration-applying means 151, the plastic deformation of the material is promoted in the edger 150, and therefore similar effects as described in the embodiment of FIG. 24 are achieved. And besides, thanks to the effect of vibrations produced by the vibration-applying means 152, the plastic deformation of the material in the coarse rolling mills 105 are promoted, so that the amount of reduction or pressing of the material by coarse rolling can be increased, and the precision is enhanced. Therefore, not only the reduction of the rolling load and energy and the compact design of the coarse rolling mills can be achieved, but also the number of finish rolling mills 106 can be reduced. Therefore, advantageously, the overall length of the production equipment can be reduced, and the installation cost can be reduced.

Additionally, vibration-applying means may be provided on the finish rolling mills. With this construction, greater effects can be achieved.

As described above, with the use of the widthwise-compressing machine and the rolling mill of the present invention, the material can be vibrated at a higher frequency, and therefore it is possible to vibrate the material at an extremely high frequency close to the resonance frequency of the material, so that the plastic deformation of the material is further promoted, and the material is deformed uniformly up to the widthwise central portion thereof.

Thus, since compressing ability of the widthwise-compressing machine, as well as the pressing ability of the rolling mill, is increased, the force and energy required for the working can be small, and the enhanced production ability and the reduction of the production cost can be achieved. And, since the working precision is enhanced, the quality and yield of the product can be improved.

The widthwise-compressing machine, as well as the rolling mill, can be of a smaller size than the conventional machines, and the space for installing the production equipment, as well as the installation cost, can be reduced. Thus, in the present invention, great effects can be obtained from technical and economical points of view.

What is claimed is:

1. A widthwise-compressing machine for applying a compressive force to a material to reduce a width of the said material while applying vibrations to said material to forcibly vibrate said material, the widthwise-compressing machine comprising:

compression means for producing said compressive force forming a working force to apply said compressive force through press tools comprising anvil blocks to said material; and vibration-applying means for applying said vibration widthwise of said material, said vibration-applying means being provided independently of said compression means.

2. A widthwise-compressing machine according to claim 1, further comprising control means for operating said compression means and said vibration-applying means to apply said vibration from said vibration-applying means to said material while said compressive working force produced by said compression means is applied to said material for reducing a width of said material.

3. A widthwise-compressing machine according to claim 2, wherein said compressive working force produced by said compression means and applied to said material is a relatively large working force and said vibration from said vibration applying means applied to said material is relatively small in force.

4. A widthwise-compressing machine according to claim 3, wherein said vibration-applying means applies said vibration to said material at a relatively high frequency of several kHz in order to resonate said material.

5. A method of controlling a widthwise-compressing machine for applying a compressive force to a material to reduce a width of the said material while applying vibrations to said material to forcibly vibrate said material, the method comprising the steps of:

applying a compressive force forming a working force by compression means for producing said compressive force through press tools comprising anvil blocks to said material; and applying said vibration widthwise of said material by vibration-applying means provided independently of said compression means.

6. A method of controlling a widthwise-compressing machine according to claim 5, wherein said vibration-applying means applies the vibration of which frequency is close to a resonance frequency of said material.

7. A method of controlling a widthwise-compressing machine according to claim 5, wherein vibration forces applied by said vibration-applying means are exerted in a direction different from but having at least a component in a direction of widthwise compression of said material for applying said vibration widthwise of said material.

8. A method of controlling a widthwise-compressing machine according to claim 7, wherein the vibration forces applied by said vibration-applying means are exerted in a direction of travel of said material through said anvil blocks, said anvil blocks having opposed slanting side surface contacting said material for applying said vibration widthwise of said material.

9. A method of controlling a widthwise-compressing machine according to claim 5, wherein said applying of said vibration to said material by said vibration-applying means is performed while said compressive working force is applied to said material by said compression means.

10. A method of controlling a widthwise-compressing machine according to claim 9, wherein said compressive working force is relatively large and said vibration from said vibration-applying means applied to said material is relatively small in force.

11. A method of controlling a widthwise-compressing machine according to claim 10, wherein a frequency of said vibration applied to said material by said vibration-applying means is a relatively high frequency of several kHz in order to resonate said material.

12. A method of controlling a widthwise-compressing machine according to claim 5, further including varying a frequency of the vibration forces applied by said vibration-applying means in accordance with the change in size of said material.

13. A method of controlling a widthwise-compressing machine for applying a compressive force to a material to reduce a width of the material while applying vibrations to said material to forcibly vibrate said material, the method comprising the steps of:

applying a compressive force forming a working force by compression means for producing said compressive force through press tools to said material; and applying said vibration not through said press tools to said material by vibration-applying means provided independently of said compression means, wherein vibration forces applied by said vibration-applying means are exerted in the same direction as a direction of widthwise compression of said material.

14. A method of controlling a widthwise-compressing machine for applying a compressive force to a material to reduce a width of the material while applying vibrations to said material to forcibly vibrate said material, the method comprising the steps of:

applying a compressive force forming a working force by compression means for producing said compressive force through press tools to said material; and applying said vibration not through said press tools to said material by vibration-applying means provided independently of said compression means, wherein vibration forces applied by said vibration-applying means are exerted in a different direction from a direction of widthwise compression of said material, and wherein the vibration forces applied by said vibration-applying means are exerted in a direction of a thickness of said material.

15. A widthwise-compressing machine for applying a compressive force to a material through press tools to reduce a width of the said material while applying vibrations to said material to forcibly vibrate said material, the widthwise-compressing machine comprising:

compression means for producing said compressive force forming a working force; and a fluid pressure unit serving as vibration-applying means for applying said vibration in a thickness direction of said material not through said press tools to said material, said fluid pressure unit being provided independently of said compression means.

16. A width-wise compressing machine according to claim 15, further comprising control means for operating said compression means and said vibration-applying means to apply said vibration from said vibration-applying means to said material while said compressive working force produced by said compression means is applied to said material for reducing the width of said material.

17. A width-wise compressing machine according to claim 16, wherein said compressive working force produced by said compression means and applied to said material is a relatively large working force and said vibration from said vibration-applying means applied to said material is relatively small in force.

18. A width-wise compressing machine according to claim 17, wherein said vibration-applying means applies said vibration to said material at a relatively high frequency of several kHz in order to resonate said material.

19. A widthwise-compressing machine for applying a compressive force to a material through press tools to reduce a width of the said material while applying vibrations to said material to forcibly vibrate said material, the widthwise-compressing machine comprising:

a first fluid pressure unit serving as compression means for producing said compressive force forming a working force; and a second fluid pressure unit serving as vibration-applying means for applying said vibration widthwise of said material not through said press tools to said material, said second fluid pressure unit being provided independently of said first fluid unit.

20. A widthwise-compressing machine according to claim 19, wherein an operating fluid used in said first fluid unit serving as said compression means is different from that used in said second fluid unit serving as said vibration-applying means.

21. A width-wise compressing machine according to claim 19, further comprising control means for operating said compression means and vibration-applying means to apply said vibration from said vibration-applying means to said material while said compression working force produced by said compression means is applied to said material for reducing a width of said material.

22. A widthwise-compressing machine according to claim 21, wherein said compressive working force produced by said compression means and applied to said material is a relatively large working force and said vibration from said vibration-applying means applied to said material is relatively small in force.

23. A widthwise-compressing machine according to claim 22, wherein said vibration-applying means applies said vibration to said material at a relatively high frequency of several kHz in order to resonate said material.

24. A rolling mill for rolling a material by applying a rolling load to the material through working rolls to reduce a thickness of said material while applying vibrations to said material to forcibly vibrate said material, the rolling mill comprising:

pressing means for producing said rolling load forming a working force; and a fluid pressure unit serving as vibration-applying means for applying said vibration in a thickness direction of said material not through said pressing means to said material, said fluid pressure unit being provided independently of said pressing means.

25. A rolling mill according to claim 24, wherein said vibration-applying means applies the vibration not through said working rolls.

26. A rolling mill according to claim 24, further comprising control means for operating said pressing means and said vibration-applying means to apply said vibration from said vibration-applying means to said material while said working force produced by said pressing means is applied to said material for reducing a width of said material.

27. A rolling mill according to claim 26, wherein said working force produced by said pressing means and applied to said material is a relatively large working force and said vibration from said vibration-applying means applied to said material is relatively small in force.

28. A rolling mill according to claim 27, wherein said vibration-applying means applies said vibration to said material at a relatively high frequency of several kHz in order to resonate said material.

29. Rolling facilities provided with one or a group of rolling mills for rolling a material by applying a rolling load to the material through working rolls to reduce a thickness of said material, the rolling mill comprising at least one of:

a widthwise-compressing machine having compression means for producing a compression force forming a working force, and vibration-applying means for applying vibration widthwise of said material not through said compression means to said material, said vibration-applying means being provided independently from said compression means; or a rolling mill having pressing means for producing a rolling load forming a working force, and vibration-applying means for applying the vibration in a thickness direction of said material not through said pressing means to said material, said vibration-applying means being provided independently of said compression means.

30. A widthwise-compressing machine for applying a compressive force to a material to reduce a width of the said material while applying vibrations to said material to forcibly vibrate said material, the widthwise-compressing machine comprising:

compression means for producing said compressive force forming a working force to apply said compressive force through press tools comprising rotary rolls to said material; and vibration-applying means for applying said vibration widthwise of said material, said vibration-applying means being provided independently of said compression means.

31. A method of controlling a widthwise-compressing machine for applying a compressive force to a material to reduce a width of the material while applying vibrations to said material to forcibly vibrate said material, the method comprising the steps of:

applying a compressive force forming a working force by compression means for producing said compressive force through press tools comprising rotary rolls to said material; and applying said vibration widthwise of said material by vibration-applying means provided independently of said compression means.

* * * * *